US011289824B2

(12) United States Patent
Tehran et al.

(10) Patent No.: US 11,289,824 B2
(45) Date of Patent: Mar. 29, 2022

(54) DUAL-BAND AND DUAL-POLARIZED MM-WAVE ARRAY ANTENNAS WITH IMPROVED SIDE LOBE LEVEL (SLL) FOR 5G TERMINALS

(71) Applicant: Samsung Electronics Co., Ltd., Suwon-si (KR)

(72) Inventors: Hamid Reza Memar Zadeh Tehran, Frisco, TX (US); Sung-Chul Park, Seoul (KR); Gary Xu, Allen, TX (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/856,771

(22) Filed: Apr. 23, 2020

(65) Prior Publication Data

US 2021/0066817 A1 Mar. 4, 2021

Related U.S. Application Data

(60) Provisional application No. 62/894,322, filed on Aug. 30, 2019, provisional application No. 62/912,851, (Continued)

(51) Int. Cl.
*H01Q 1/38* (2006.01)
*H01Q 21/24* (2006.01)
(Continued)

(52) U.S. Cl.
CPC ..... *H01Q 21/24* (2013.01); *H01Q 1/38* (2013.01); *H01Q 9/0414* (2013.01); *H01Q 21/065* (2013.01)

(58) Field of Classification Search
CPC ..... H01Q 21/24; H01Q 21/065
(Continued)

(56) References Cited

U.S. PATENT DOCUMENTS 6,333,720 B1 12/2001 Gottl et al.
7,969,378 B2 * 6/2011 Bongfeldt ..... H01Q 21/08 343/801
(Continued)

FOREIGN PATENT DOCUMENTS

CN 2838058 Y 11/2006
CN 104518282 A 4/2015
KR 10-2001-0042252 A 5/2001

OTHER PUBLICATIONS

Liu et al., "A Dual-Band Beam-Switched Slot Array for GSM 900/1800MHz", Proceedings of Asia-Pacific Microwave Conference, Dec. 2006, 4 pages.
(Continued)

*Primary Examiner* — Peguy Jean Pierre

(57) ABSTRACT

An antenna array and a user equipment (UE) including the antenna array. The antenna array includes a plurality of unit cells. Each unit cells includes first and second patches, phase shift transmission lines, a third patch, and a transmission line. The first and second patches radiate at a first frequency band and positioned in a first plane of the antenna array. The phase shift transmission lines connect the first and second patches and shift a phase of a signal between the first and second patches. The third patch is positioned in a second plane of the antenna array and beneath the first patch and radiates at a second frequency band that is lower than the first frequency band. The transmission line excites at least the third patch.

20 Claims, 15 Drawing Sheets

Related U.S. Application Data filed on Oct. 9, 2019, provisional application No. 62/924,397, filed on Oct. 22, 2019.

(51) Int. Cl.
*H01Q 9/04* (2006.01)
*H01Q 21/06* (2006.01)

(58) Field of Classification Search
USPC ..... 343/810
See application file for complete search history.

(56) References Cited

U.S. PATENT DOCUMENTS

| | | | | |
|---|---|---|---|---|
| 2010/0171675 | A1 | 7/2010 | Borja et al. | |
| 2012/0139811 | A1* | 6/2012 | Singh | H01Q 1/2216 343/850 |
| 2019/0260115 | A1 | 8/2019 | Tehran et al. | |
| 2020/0403322 | A1* | 12/2020 | Ryu | H01Q 1/243 |

OTHER PUBLICATIONS

Luo et al., "Interleaved Dual-band Circularly Polarized Active Array Antenna for Satellite Communications", 9th European Conference on Antennas and Propagation (EuCAP), Apr. 2015.
da Costa et al., "Dual-Band Antenna Array with Beam Steering for mm-waves 5G Networks", SBMO/IEEE MTT-S International Microwave and Optoelectronics Conference (IMOC), Aug. 2017, 4 pages.
Samadi Taheri et al., "Integrated Millimeter-Wave Wideband End-Fire 5G Beam Steerable Array and Low-Frequency 4G LTE Antenna in Mobile Terminals", IEEE Transactions on Vehicular Technology, vol. 68, No. 4, Apr. 2019, pp. 4042-4046.
Sutinjo et al., "An Octave Band Switched Parasitic Beam-Steering Array", IEEE Antennas and Wireless Propagation Letters, vol. 6, Apr. 2007, pp. 211-214.
West et al., "Measured Results of a Dual-Band Dual-Mode Millimeter Wave Analog EMXT Waveguide Phase Shifter Electronically Scanned Antenna (ESA)", IEEE Antennas and Wireless Propagation Letters, vol. 5, Mar. 2006, pp. 7-10.
Gan et al., "Dual-Band and Dual-Polarized Reconfigurable Beam-Steering Array for WLAN Applications", IEEE International Symposium on Antennas and Propagation and USNC-URSI Radio Science Meeting, Jul. 2019, 2 pages.
Elhabbash et al., "Design of Dual-band Dual-polarized MIMO Antenna for mm-wave 5G Base Stations with Octagonal Prism Structure", IEEE 7th Palestinian International Conference on Electrical and Computer Engineering (PICECE), Mar. 2019, 6 pages.
Liu et al., "Compact Dual-Band Antenna With Electronic Beam-Steering and Beamforming Capability", IEEE Antennas and Wireless Propagation Letters, vol. 10, Nov. 2011, pp. 1349-1352.
International Search Report dated Nov. 13, 2020 in connection with International Patent Application No. PCT/KR2020/010085, 3 pages.
Written Opinion of the International Searching Authority dated Nov. 13, 2020 in connection with International Patent Application No. PCT/KR2020/010085, 5 pages.

* cited by examiner

DUAL-BAND AND DUAL-POLARIZED MM-WAVE ARRAY ANTENNAS WITH IMPROVED SIDE LOBE LEVEL (SLL) FOR 5G TERMINALS

CROSS-REFERENCE TO RELATED APPLICATION AND CLAIM OF PRIORITY

This application claims priority under 35 U.S.C. § 119(e) to U.S. Provisional Patent Application No. 62/894,322 filed on Aug. 30, 2019, U.S. Provisional Patent Application No. 62/912,851 filed on Oct. 9, 2019, and U.S. Provisional Patent Application No. 62/924,397 filed on Oct. 22, 2019, the disclosures of which are incorporated herein by reference in their entireties.

TECHNICAL FIELD

The present disclosure relates generally to a user equipment (UE) that includes a 5G module. More particularly, the present disclosure relates to a UE that operates at two separate bands.

BACKGROUND

The next generation of telecommunication infrastructure is realized through the implementation of 5G networks. The 5G networks require new developments for both the backbone infrastructure and user equipments (UEs), particularly hand-held devices such as smartphones, wearable devices, etc. Refurbishing existing networks such as 4G/LTE networks can facilitate the realization of 5G network for designated frequencies at sub-6 GHz only because of the almost identical form factor. However, the associated radiofrequency (RF) transceivers for sub-6 GHz (e.g., Massive MIMO) are different. Practical solutions can be implemented for the sub-6 GHz band of 5G networks. However, 5G millimeter wave (mmWave) solutions that operate at two separate frequencies, such as 28 GHz and 39 GHz, face challenges such as reduced efficiency, propagation loss, and foliage and environmental interaction. For example, incorporating 5G mmWave equipment in existing UEs can be challenging because of the presence of electronics for seamless communications within 4G/LTE networks, limited physical dimensions, a higher loss, particularly the ones associated with transitions and interconnects, etc.

SUMMARY

The present disclosure relates to dual-band and dual-band polarized mmWave array antennas with an improved, or reduced, side lobe level.

In one embodiment, an antenna array includes a plurality of unit cells. Each unit cells includes first and second patches, phase shift transmission lines, a third patch, and a transmission line. The first and second patches are configured to radiate at a first frequency band and positioned in a first plane of the antenna array. The phase shift transmission lines connect the first and second patches and are configured to shift a phase of a signal between the first and second patches. The third patch is positioned in a second plane of the antenna array and beneath the first patch and radiates at a second frequency band that is lower than the first frequency band. The transmission line is configured to excite at least the third patch.

In another embodiment, a user equipment (UE) includes a transceiver configured to transmit and receive signals via an antenna array. The antenna array is operably connected to the transceiver and includes a plurality of unit cells. Each unit cell includes first and second patches, phase shift transmission lines, a third patch, and a transmission line. The first and second patches are configured to radiate at a first frequency band and positioned in a first plane of the antenna array. The phase shift transmission lines connect the first and second patches and are configured to shift a phase of a signal between the first and second patches. The third patch is positioned in a second plane of the antenna array and beneath the first patch and radiates at a second frequency band that is lower than the first frequency band. The transmission line is configured to excite at least the third patch.

In this disclosure, the terms antenna, antenna module, antenna array, beam, and beam steering are frequently used. An antenna module may include one or more arrays. One antenna array may include one or more antenna elements. Each antenna element may be able to provide one or more polarizations, for example vertical polarization, horizontal polarization or both vertical and horizontal polarizations at or around the same time. Vertical and horizontal polarizations at or around the same time can be refracted to an orthogonally polarized antenna. An antenna module radiates the accepted energy in a particular direction with a gain concentration. The radiation of energy in the particular direction is conceptually known as a beam. A beam may be a radiation pattern from one or more antenna elements or one or more antenna arrays.

Other technical features may be readily apparent to one skilled in the art from the following figures, descriptions, and claims.

Before undertaking the DETAILED DESCRIPTION below, it may be advantageous to set forth definitions of certain words and phrases used throughout the present disclosure. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout the present disclosure. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which like reference numerals represent like parts.

DETAILED DESCRIPTION

FIGS. 1 through 15C, discussed below, and the various embodiments used to describe the principles of the present disclosure are by way of illustration only and should not be construed in any way to limit the scope of the disclosure. Those skilled in the art will understand that the principles of the present disclosure may be implemented in any suitably arranged wireless communication system.

To meet the demand for wireless data traffic having increased since deployment of 4G communication systems, efforts have been made to develop an improved 5G or pre-5G communication system. Therefore, the 5G or pre-5G communication system is also called a "beyond 4G network" or a "post LTE system."

The 5G communication system is implemented in higher frequency (mmWave) bands and sub-6 GHz bands, e.g., 3.5 GHz bands, to accomplish higher data rates. To decrease propagation loss of the radio waves and increase the transmission coverage, the beamforming, Massive MIMO, full dimensional MIMO (FD-MIMO), array antenna, an analog beam forming, large scale antenna techniques and the like are discussed in 5G communication systems.

In addition, in 5G communication systems, development for system network improvement is under way based on advanced small cells, cloud radio access networks (RANs), ultra-dense networks, device-to-device (D2D) communication, wireless backhaul communication, moving network, cooperative communication, coordinated multi-points (CoMP) transmission and reception, interference mitigation and cancellation and the like.

Figure 1:
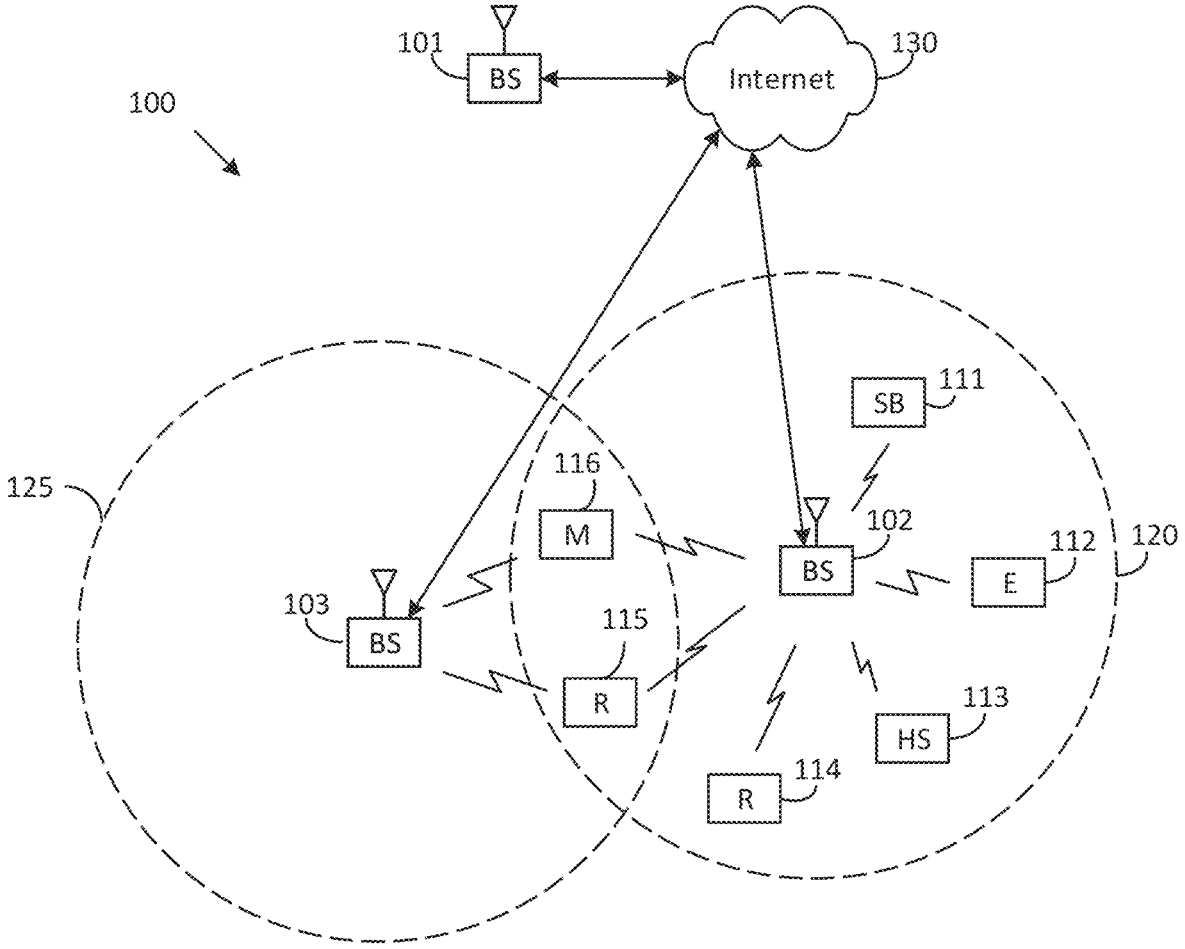
FIG. 1 illustrates an example wireless network according to various embodiments of the present disclosure.

FIG. 1 illustrates an example wireless network according to embodiments of the present disclosure. The embodiment of the wireless network shown in FIG. 1 is for illustration only. Other embodiments of the wireless network 100 can be used without departing from the scope of this disclosure.

As shown in FIG. 1, the wireless network 100 includes a gNB 101, a gNB 102, and a gNB 103. The gNB 101 communicates with the gNB 102 and the gNB 103. The gNB 101 also communicates with at least one network 130, such as the Internet, a proprietary Internet Protocol (IP) network, or other data network.

The gNB 102 provides wireless broadband access to the network 130 for a first plurality of UEs within a coverage area 120 of the gNB 102. The first plurality of UEs includes a UE 111, which may be located in a small business (SB); a UE 112, which may be located in an enterprise (E); a UE 113, which may be located in a WiFi hotspot (HS); a UE 114, which may be located in a first residence (R); a UE 115, which may be located in a second residence (R); and a UE 116, which may be a mobile device (M), such as a cell phone, a wireless laptop, a wireless PDA, or the like. The gNB 103 provides wireless broadband access to the network 130 for a second plurality of UEs within a coverage area 125 of the gNB 103. The second plurality of UEs includes the UE 115 and the UE 116. In some embodiments, one or more of the gNBs 101-103 may communicate with each other and with the UEs 111-116 using 5G, LTE, LTE-A, WiMAX, WiFi, or other wireless communication techniques.

Depending on the network type, the term "base station" or "BS" can refer to any component (or collection of components) configured to provide wireless access to a network, such as transmit point (TP), transmit-receive point (TRP), an enhanced base station (eNodeB or gNB), a 5G base station (gNB), a macrocell, a femtocell, a WiFi access point (AP), or other wirelessly enabled devices. Base stations may provide wireless access in accordance with one or more wireless communication protocols, e.g., 5G 3GPP new radio interface/access (NR), long term evolution (LTE), LTE advanced (LTE-A), high speed packet access (HSPA), Wi-Fi 802.11a/b/g/n/ac, etc. For the sake of convenience, the terms "BS" and "TRP" are used interchangeably in the present disclosure to refer to network infrastructure components that provide wireless access to remote terminals. Also, depending on the network type, the term "user equipment" or "UE" can refer to any component such as "mobile station," "subscriber station," "remote terminal," "wireless terminal," "receive point," or "user device." For the sake of convenience, the terms "user equipment" and "UE" are used in the present disclosure to refer to remote wireless equipment that wirelessly accesses a BS, whether the UE is a mobile device (such as a mobile telephone or smartphone) or is normally considered a stationary device (such as a desktop computer or vending machine).

Dotted lines show the approximate extents of the coverage areas 120 and 125, which are shown as approximately circular for the purposes of illustration and explanation only. It should be clearly understood that the coverage areas associated with gNBs, such as the coverage areas 120 and 125, may have other shapes, including irregular shapes, depending upon the configuration of the gNBs and variations in the radio environment associated with natural and man-made obstructions.

Although FIG. 1 illustrates one example of a wireless network, various changes may be made to FIG. 1. For example, the wireless network could include any number of gNBs and any number of UEs in any suitable arrangement. The gNB 101 could communicate directly with any number of UEs and provide those UEs with wireless broadband access to the network 130. Similarly, each gNB 102-103 could communicate directly with the network 130 and provide UEs with direct wireless broadband access to the network 130. Further, the gNBs 101, 102, and/or 103 could provide access to other or additional external networks, such as external telephone networks or other types of data networks.

Figure 2:
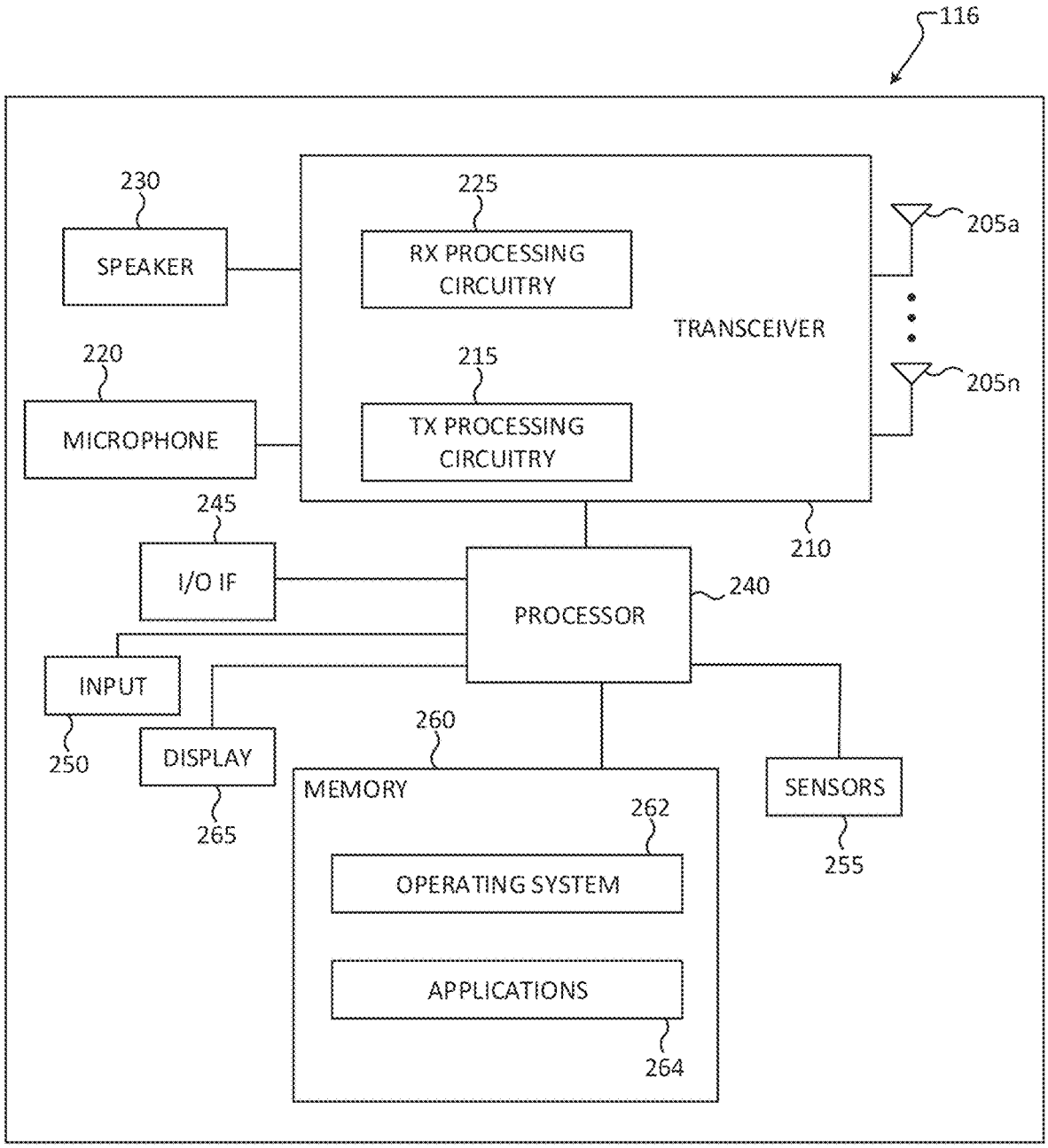
FIG. 2 illustrates an example user equipment (UE) according to various embodiments of the present disclosure.

FIG. 2 illustrates an example UE 116 according to various embodiments of the present disclosure. The embodiment of the UE 116 illustrated in FIG. 2 is for illustration only, and the UEs 111-115 of FIG. 1 can have the same or similar configuration. However, UEs come in a wide variety of configurations, and FIG. 2 does not limit the scope of the present disclosure to any particular implementation of a UE.

The UE 116 includes one or more transceivers 210, a microphone 220, a speaker 230, a processor 240, an input/output (I/O) interface 245, an input 250, one or more sensors 255, a display 265, and a memory 260. The memory 260 includes an operating system (OS) program 262 and one or more applications 264.

The transceiver 210 includes transmit (TX) processing circuitry 215 to modulate signals, receive (RX) processing circuitry 225 to demodulate signals, and an antenna array 205 including antennas to send and receive signals. The antenna array 205 receives an incoming signal transmitted by a gNB of the wireless network 100 of FIG. 1. The transceiver 210 down-converts the incoming RF signal to generate an intermediate frequency (IF) or baseband signal. The IF or baseband signal is sent to the RX processing circuitry 225, which generates a processed baseband signal by filtering, decoding, and/or digitizing the baseband or IF signal. The RX processing circuitry 225 transmits the processed baseband signal to the speaker 230 (such as for voice data) or to the processor 240 for further processing (such as for web browsing data).

The TX processing circuitry 215 receives analog or digital voice data from the microphone 220 or other outgoing baseband data (such as web data, e-mail, or interactive video game data) from the processor 240. The TX processing circuitry 215 encodes, multiplexes, and/or digitizes the outgoing baseband data to generate a processed baseband or IF signal. The RF transceiver 210 receives the outgoing processed baseband or IF signal from the TX processing circuitry 215 and up-converts the baseband or IF signal to an RF signal that is transmitted by the antenna array 205.

The processor 240 can include one or more processors or other processing devices and execute the OS program 262 stored in the memory 260 in order to control the overall operation of the UE 116. For example, the processor 240 can control the reception of forward channel signals and the transmission of reverse channel signals by the RF transceiver 210, the RX processing circuitry 225, and the TX processing circuitry 215 in accordance with well-known principles. In some embodiments, the processor 240 includes at least one microprocessor or microcontroller.

The processor 240 can execute other processes and programs resident in the memory 260, such as operations for transmitting dual polarized beams as described in embodiments of the present disclosure. The processor 240 can move data into or out of the memory 260 as part of an executing process. In some embodiments, the processor 240 is configured to execute the applications 264 based on the OS program 262 or in response to signals received from gNBs or an operator. The processor 240 is also coupled to the I/O interface 245, which provides the UE 116 with the ability to connect to other devices such as laptop computers and handheld computers. The I/O interface 245 is the communication path between these accessories and the processor 240.

The processor 240 is also coupled to the input 250 (e.g., keypad, touchscreen, button etc.) and the display 265. The operator of the UE 116 can use the input 250 to enter data into the UE 116. The display 265 can be a liquid crystal display or other display capable of rendering text and/or at least limited graphics, such as from web sites.

The memory 260 is coupled to the processor 240. The memory 260 can include at least one of a random-access memory (RAM), Flash memory, or other read-only memory (ROM).

As described in more detail below, the UE 116 can include a dual-band and dual-band polarized mmWave array antennas with an improved, or reduced, side lobe level. Although FIG. 2 illustrates one example of UE 116, various changes can be made to FIG. 2. For example, various components in FIG. 2 can be combined, further subdivided, or omitted and additional components can be added according to particular needs. As a particular example, the processor 240 can be divided into multiple processors, such as one or more central processing units (CPUs) and one or more graphics processing units (GPUs). Although FIG. 2 illustrates the UE 116 as a mobile telephone or smartphone, UEs can be configured to operate as other types of mobile or stationary devices.

The UE 116 can control the transceiver 210 to transmit and receive signals in an upper band and a lower band. For example, the upper band can be a frequency of 39 GHz and the lower band can be a frequency of 28 GHz. However, various embodiments of the present disclosure recognize that operating at separate frequency bands of 28 GHz and 39 GHz can result in reduced efficiency, propagation loss, and foliage and environmental interaction. Further, the design of the antenna array of the UE 116 is complicated by the difference in wavelengths between the frequency bands of 28 GHz and 39 GHz. In particular, because the array's element spacing is fixed, the optimum separation for a full scan at both frequencies, 28 GHz and 39 GHz, cannot be realized. For example, $\lambda_{f=28\ GHz}=\sim 1.4\times\lambda_{f=39\ GHZ}$. While various embodiments discuss using dual bands at example frequencies of 28 GHz and 39 GHz, the present disclosure is not limited thereto and any suitable frequency bands may be utilized in embodiments of the present disclosure.

Figure 3:
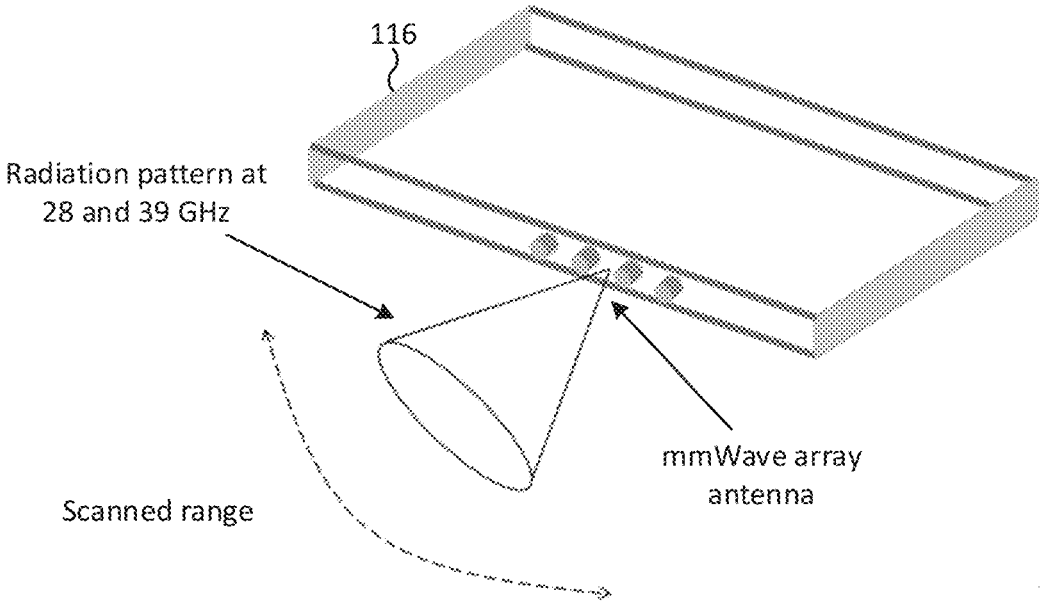
FIG. 3 illustrates a 5G terminal including a mmWave module.

For example, FIG. 3 illustrates a 5G terminal that includes a mmWave module. As shown in FIG. 3, the 5G terminal can be the UE 116. The UE 116 includes a mmWave antenna array that includes a scanned range at the operation frequencies of 28 GHz and 39 GHz. The 5G terminal illustrated in FIG. 3 is limited, for example by the physical dimensions of the terminal itself, in the opportunities to address and correct the aforementioned challenges such as reduced efficiency, propagation loss, and foliage and environmental interaction.

Accordingly, various embodiments of the present disclosure provide an antenna and an antenna array that gains equalization at both the 28 GHz and 39 GHz bands to compensate for a difference in the propagation loss of the two frequencies. Various embodiments of the present disclosure further provide an antenna and an antenna array that improve a side lobe level (SLL) at an upper band, such as the 39 GHz band, scanning due to element spacing. Finally, various embodiments of the present disclosure provide an antenna and an antenna array that can transmit dual-polarized radiation in an orthogonal fashion, such as both vertical/horizontal and slanted plus/minus forty five degrees.

Figure 4A:
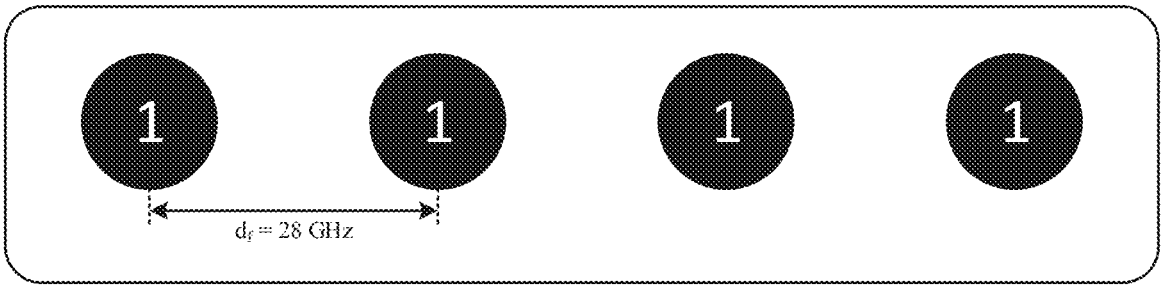
FIG. 4A is a schematic illustrating a mmWave antenna array comprising four elements operating at 28 GHz.

FIG. 4A is a schematic illustrating a mmWave antenna array comprising four elements. The four elements (1) operate at a frequency of 28 GHz, shown as $d_f$=28 GHz. Where $d_f$=28 GHz, the optimal spacing between each of the four elements (1) is 5.35 mm. The array illustrated in FIG. 4A can provide 6 dBi of directivity.

Figure 4B:
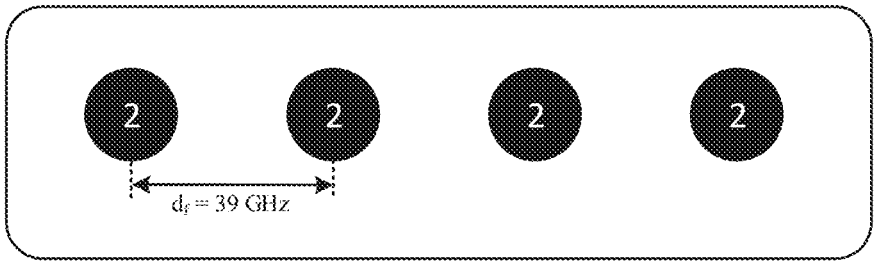
FIG. 4B is a schematic illustrating a mmWave antenna array comprising four elements operating at 39 GHz.

FIG. 4B is a schematic illustrating a mmWave antenna array comprising four elements. The four elements (2) operate at a frequency of 39 GHz, shown as $d_f$=39 GHz. Where $d_f$=39 GHz, the array illustrated in FIG. 4B can provide 7.1 dBi of directivity because of a larger inter-element spacing where $d_f$=39 GHz is 5.35 mm. For example, Table 1 illustrates an example of achievable gains for arrays with different inter-element spacing.

| FREQUENCY | ELEMENT SPACING | AF (4-EL. ARRAY) dBi |
|---|---|---|
| 28 GHz | $d_f$ = 28 GHz = 3.84 mm | 4.77 (Dir.) |
| 28 GHz | $d_f$ = 28 GHz = 5.354 mm | 6 (Dir.) |
| 39 GHz | $d_f$ = 39 GHz = 3.84 mm | 6 (Dir.) |
| 39 GHz | $d_f$ = 39 GHz = 5.35 mm | 7.16 (Dir.) |

As shown in Table 1, the array with $d_f$=39 GHz=0.5×$\lambda_f$=39 GHz provides a 6 dBi gain similar to an array operating at 28 GHz with inter-element spacing of 5.35 mm. The four element array with element spacing of $d_f$=39 GHz=5.35 mm=0.5×$\lambda_f$=28 GHz can provide a higher gain compared to its lower frequency counterpart. However, the array can suffer a limited beam-steering capability.

As shown in Table 1, two separate arrays can be used to achieve a dual-band operation. However, various embodiments of the present disclosure recognize that separate arrays may be impractical due to physical limitations of UEs. In particular, separate arrays may be impractical when the UE is a smartphone device. Therefore, various embodiments of the present disclosure provide collocated dual-band elements to form an array that overcomes the physical limitations of a smartphone.

Figure 5:
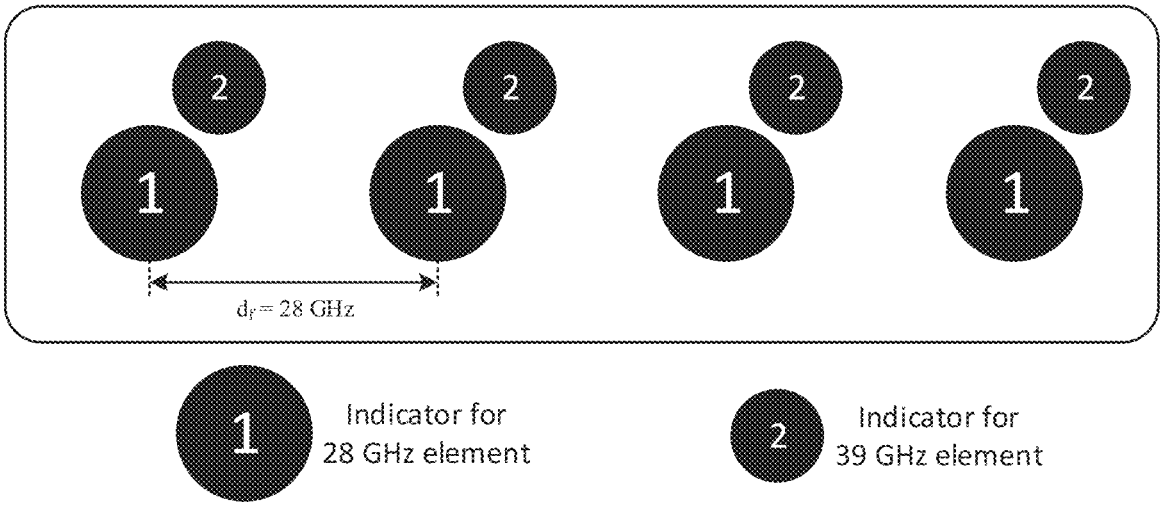
FIG. 5 illustrates a collocated dual-band array antenna according to various embodiments of the present disclosure.

For example, FIG. 5 illustrates a collocated dual-band array antenna according to various embodiments of the present disclosure. The antenna illustrated in FIG. 5 is for illustration only and should not be construed as limiting. Various features can be added to or removed from the antenna illustrated in FIG. 5 without departing from the scope of the present disclosure.

As illustrated in FIG. 5, collocated elements can be separated based on computations with respect to 28 GHz or 39 GHz. When the collocated elements are separated based on computations with respect to the 39 GHz frequency band, a lower gain is produced as shown in Table 1 for an array whose elements are separated by less than $\lambda_f$=28 GHz. Accordingly, spacing at 28 GHz ($d_f$=39 GHz=$d_f$=28 GHz=5.35 mm (0.5×$\lambda_f$=28 GHz) can be considered for elements where the collocated element at 39 GHz is located at 0.5×1.4$\lambda_f$=39 GHz, which is not an optimal spacing for beam steering.

Figure 6:
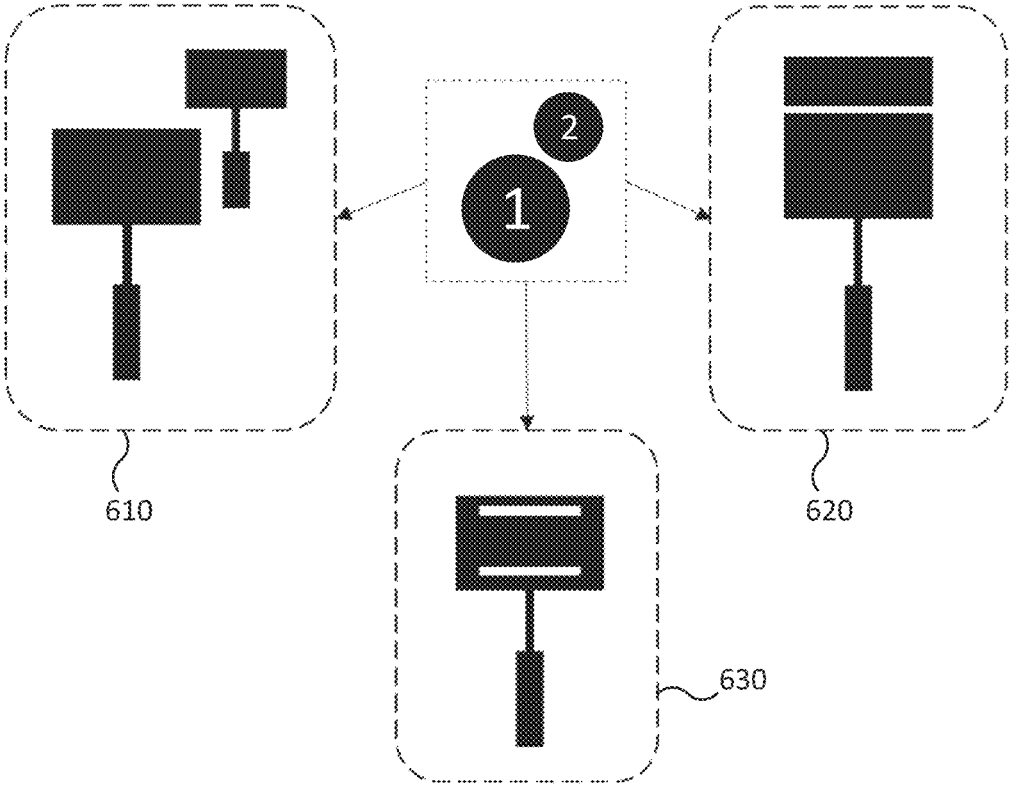
FIG. 6 illustrates collocated mmWave elements according to various embodiments of the present disclosure.

FIG. 6 illustrates collocated mmWave elements according to various embodiments of the present disclosure. The elements illustrated in FIG. 6 are for illustration only and should not be construed as limiting. Various features can be added to or removed from the elements illustrated in FIG. 6 without departing from the scope of the present disclosure. The collocated elements, or unit cells, 610, 620, 630 can implement the array illustrated in FIG. 5.

A first collocated element 610 can include separate elements for each resonance frequency. For example, the first collocated element 610 can include one element for a resonance frequency at a lower band, such as 28 GHz, and another element for a resonance frequency at a higher band, such as 39 GHz.

A second collocated element 620 can include an antenna with separate parasitic elements for a lower band and an upper band. For example, the second collocated element 620 can be a single unit cell with one parasitic element for resonance at the lower band, such as 28 GHz, and another parasitic element for resonance at the upper band, such as 39 GHz.

A third collocated element 630 can include a slot-loaded antenna for dual-band operation at multiple frequencies. For example, the third collocated element 630 can be a unit cell 630 that includes an antenna that, due to the slots in the antenna, can dually operate at a lower band, such as 28 GHz, and an upper band, such as 39 GHz.

The present disclosure recognizes various challenges associated with the dual-band array performance. For example, for element spacing of a collocated dual-band array at a wavelength of 28 GHz, the array at 39 GHz can produce approximately 1 dB of gain in comparison to the array at 28 GHz. The gain at 39 GHz is advantageous in some respects, but it does not provide an advantage regarding identical channel illumination, i.e. power equalization, because the propagation loss at 39 GHz is approximately 3 dB greater than the propagation loss at 28 GHz. For example, for the array illustrated in FIG. 5, for a frequency of 28/39 GHz, the gain difference is 1.16 dB and the propagation loss difference is 2.9 dB. Accordingly, various embodiments of the present disclosure improve the dual-band array antenna radiation performance, i.e. gain, when formed in a collocated manner while maintaining the form factor. In particular, various embodiments of the present disclosure compensate for approximately 2 dB.

As noted above, the collocated elements 610, 620, 630 can implement the array illustrated in FIG. 5. Various embodiments of the present disclosure further recognize the radiated gain achieved by the array implemented by one or more of the collocated elements 610, 620, 630, but further recognize the constraints of beam-steering capability at the upper frequency band, such as 39 GHz. The constraints of beam-steering capability at 39 GHz are due, at least in part, to the element spacing of 0.5×1.4$\lambda_f$=39 GHz. For example, for an array of four collocated elements in a 28 GHz and 39 GHz antenna located 5.35 mm (0.5λ×$_f$=28 GHz) apart, in broadside radiation where all elements are equally excited in phase, the overall radiation pattern outcome is as reasonably expected but a side lobe level (SLL) can be as low as 13 dB. Applying a minus one hundred degree phase progression sequentially across the array's element causes the rotation pattern at 28 GHz to rotate toward a minus thirty-four degree in the elevation plane with respect to an array distribution line. The SLL is approximately 12 dB. In contrast, the array operating at 39 GHz points toward minus twenty-four degrees with a grating lobe as high as the main lobe. Therefore, various embodiments of the present disclosure alleviate the grating lobe at the upper operation band.

In addition, various embodiments of the present disclosure enable an antenna that improves system data handling by utilizing two streams generated within one same form factor. In particular, embodiments of the present disclosure support two polarizations, such as a pair of orthogonal polarizations.

Figure 7:
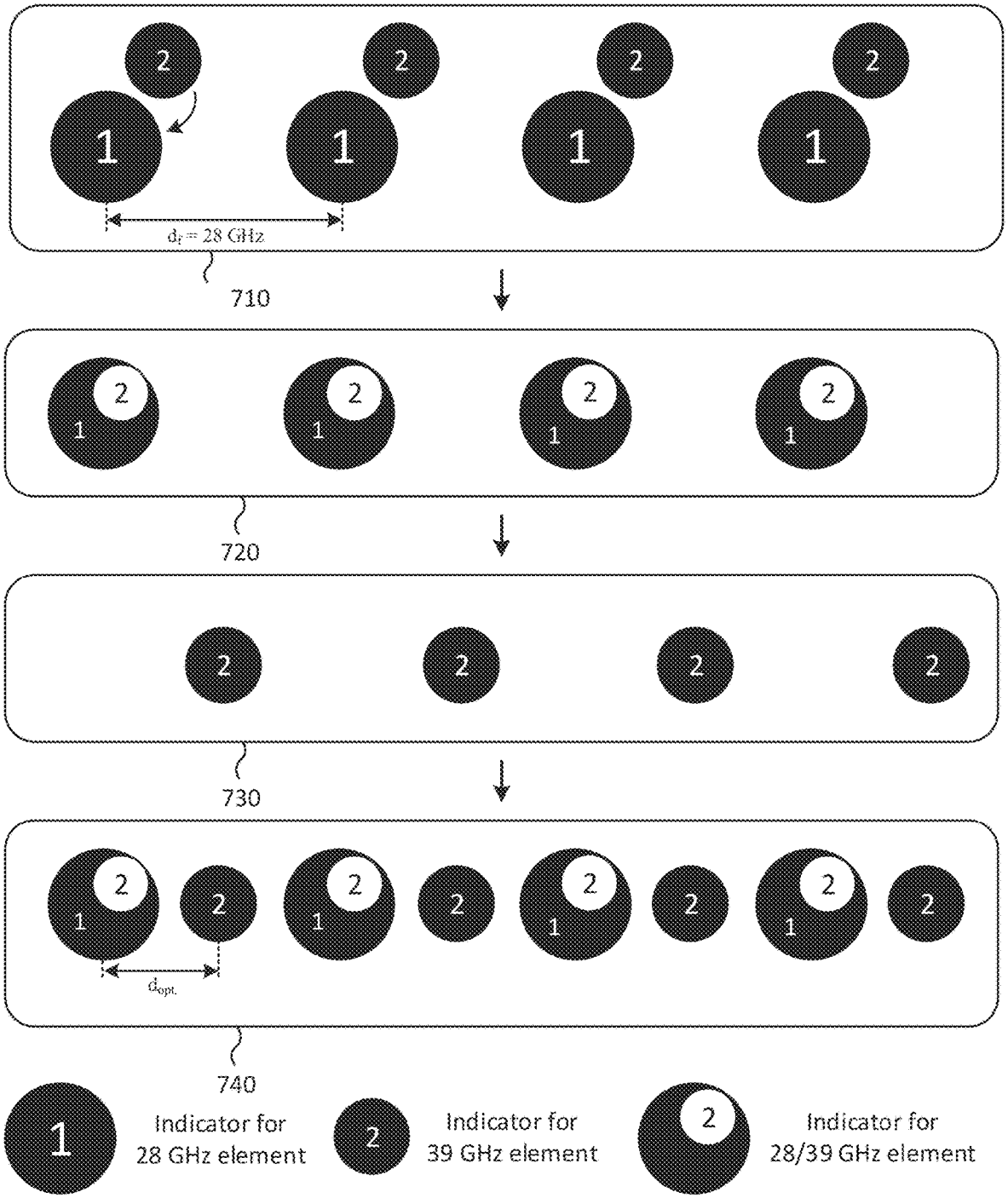
FIG. 7 illustrates an overlaid array according to various embodiments of the present disclosure.

FIG. 7 illustrates an overlaid array according to various embodiments of the present disclosure. The array illustrated in FIG. 7 is for illustration only and should not be construed as limiting. Various features can be added to or removed from the array illustrated in FIG. 7 without departing from the scope of the present disclosure. In particular, FIG. 7 illustrates the mechanism of creating a slot-loaded microstrip patch antenna 740. The antenna 740 can include one or more of the collocated elements 610, 620, 630.

The antenna 710 includes both 28 GHz elements and 39 GHz elements. FIG. 7 illustrates the antenna 710 with four 28 GHz elements and four 39 GHz elements, but various embodiments are possible. The antenna 710 can include more or fewer than four 28 GHz elements and four 39 GHz elements without departing from the scope of the present disclosure. Each 28 GHz element is separated from the adjacent 28 GHz element by $d_f$=28 GHz.

The antenna 720 includes four combined 28/39 GHz elements, illustrated by 39 GHz elements overlaid on 28 GHz elements. The 28/39 GHz elements are included in the same location on the antenna as the original 28 GHz elements in the antenna 710. Like the 28 GHz elements in antenna 710, each 28/39 GHz element is separated from the adjacent 28/39 GHz element by $d_f$=28 GHz.

The antenna 730 includes four 39 GHz elements. The antenna 740 adds the four 39 GHz elements of the antenna 730 to the four combined 28/39 GHz elements of the antenna 720. As a result, the antenna 740 includes both the four combined 28/39 GHz elements and the four 39 GHz elements disposed between the 28/39 GHz elements. In various embodiments, one 28/39 GHz elements combined with one adjacent 39 GHz element can be the unit cell 630 described in FIG. 6. The unit cell, such as the unit cell 630, will be further described in FIG. 10.

Figure 8A:
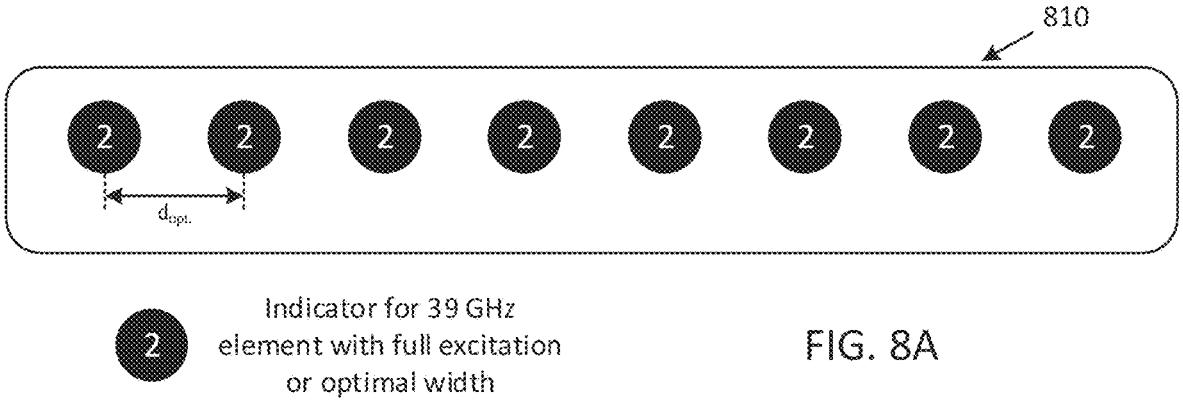
FIGS. 8A and 8B illustrate arrays operating in an upper band according to various embodiments of the present disclosure.
Figure 8B:
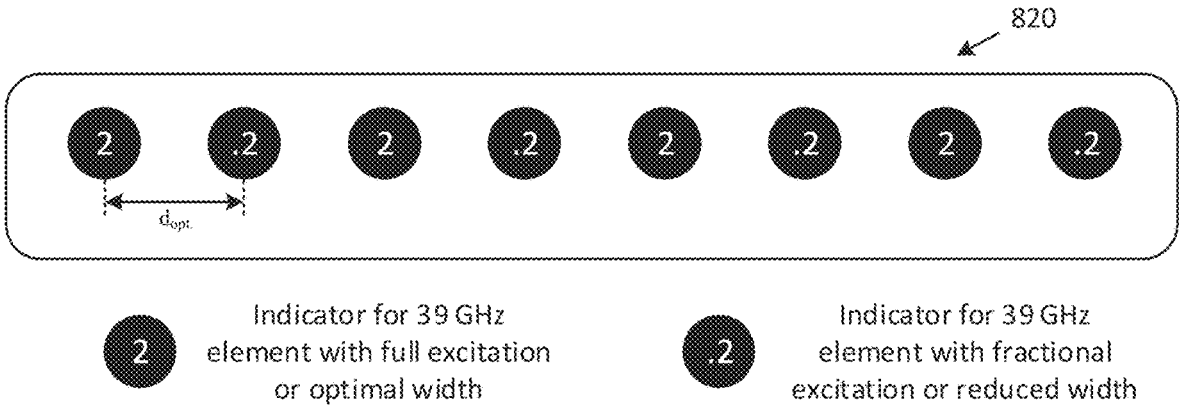

FIGS. 8A and 8B illustrate arrays operating in an upper band according to various embodiments of the present disclosure. The arrays illustrated in FIGS. 8A and 8B are for illustration only and should not be construed as limiting. Various features can be added to or removed from the arrays illustrated in FIGS. 8A and 8B without departing from the scope of the present disclosure.

FIG. 8A illustrates a linear array 810 with uniform excitement according to various embodiments of the present disclosure. In particular, FIG. 8A illustrates a linear array 810 with elements (2) operating at 39 GHz with full excitation or optimal width. The elements (2) are separated by $d_{opt}$.

FIG. 8B illustrates a linear array 820 with alternating excitation according to various embodiments of the present disclosure. In particular, FIG. 8B illustrates a linear array 820 with alternating elements with full excitation or optimal width (2) and elements with fractional excitation or reduced width (0.2). As shown in FIG. 8B, each full excitation element (2) is separated from a fractional element (0.2) by $d_{opt}$.

Radiation patterns and gain of the linear arrays 810, 820 are similar. The element spacing ($d_{opt}$) of both linear arrays 810, 820 as shown is 2.68 mm. The SLL of the linear array 810 is slightly lower than the SLL of the linear array 820. The AF (8-element array) dBi of the linear array 810 is 7.54, whereas the AF (8-element array) dBi of the linear array 820 is 7.44.

Figure 9:
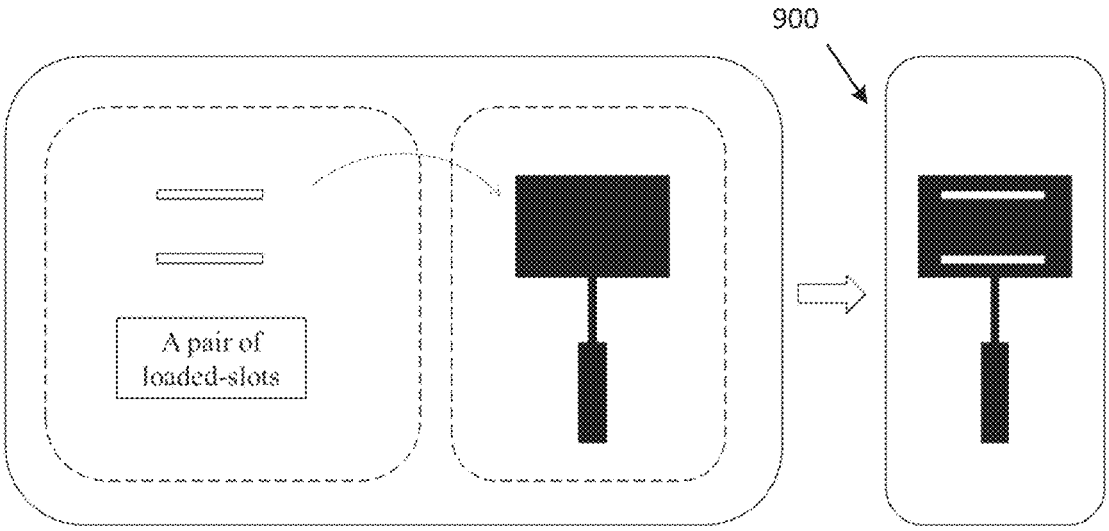
FIG. 9 illustrates a slot-loaded microstrip patch antenna according to various embodiments of the present disclosure.

FIG. 9 illustrates a slot-loaded unit cell according to various embodiments of the present disclosure. The unit cell 900 illustrated in FIG. 9 is for illustration only and should not be construed as limiting. Various features can be added to or removed from the unit cell illustrated in FIG. 9 without departing from the scope of the present disclosure. As described herein, the unit cell 900 can be implemented in dual-band and dual-band polarized mmWave array antennas to improve, or reduce, the side lobe level.

As shown in FIG. 9, the unit cell 900 can be formed by a pair of loaded slots added to a collocated element, for example the collocated element 610. The unit cell 900 is further described in the description of FIG. 10.

Figure 10:
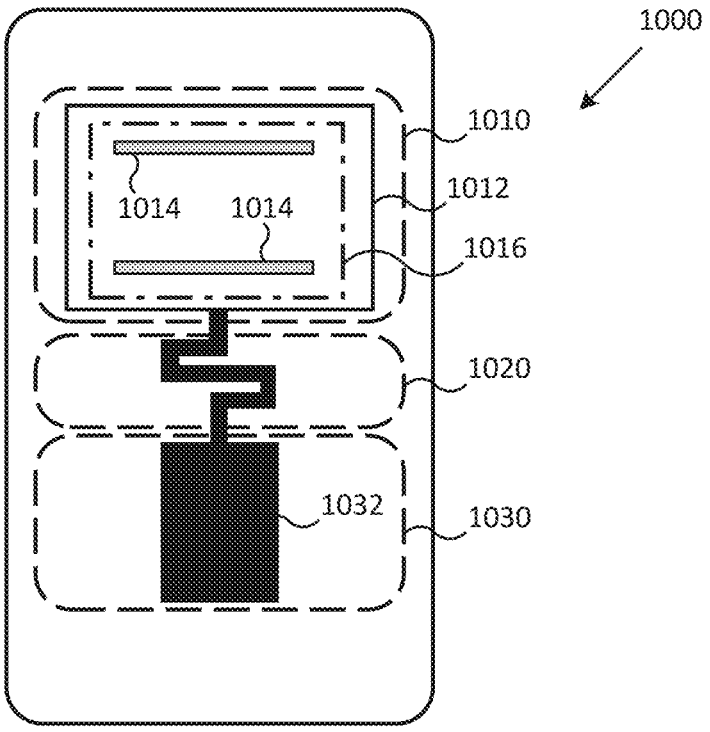
FIG. 10 illustrates a unit cell including an overlaid antenna to form a collocated antenna according to various embodiments of the present disclosure.

FIG. 10 illustrates a unit cell including an overlaid antenna to form a collocated antenna according to various embodiments of the present disclosure. The unit cell illustrated in FIG. 10 is for illustration only and should not be construed as limiting. Various features can be added to or removed from the unit cell illustrated in FIG. 10 without departing from the scope of the present disclosure. As described herein, the unit cell 1000 can be implemented in dual-band and dual-band polarized mmWave array antennas to improve, or reduce, the side lobe level.

The unit cell 1000 includes a first element 1010, a second element 1020, and a third element 1030. The first element 1010 can be the 28/39 GHz element illustrated in FIG. 7. The first element 1010 can be a microstrip patch antenna that operates at both upper and lower frequencies, such as 39 GHz and 28 GHz, respectively. The first element 1010 can include any suitable dimensions to radiate efficiently at the lower frequency and the upper frequency. In some embodiments, the first element 1010 can be referred to as a dual-band element or a dual-band antenna element.

In some embodiments, the first element 1010 can include a first patch 1012 that includes two slots 1014 and a second patch 1016 below the first patch 1012. The first patch 1012 can be overlaid on the second patch 1016. The first patch 1012 and the second patch 1016 can be provided on two separate planes. The two slots 1014 are arranged parallel to each other. The slots 1014 modify the radiation pattern of the patch 1012 at a second order mode and tune the respective resonance frequency at 39 GHz.

The third element 1030 is a single tone antenna element. The third element 1030 includes a patch 1032 that radiates at only one of the upper frequency and lower frequency. For example, the third element 1030 can radiate at only the upper frequency, for example 39 GHz. In some embodiments, the patch 1032 can be analogous to the second patch of the first element 1010 and provided on the same plane as the second patch of the first element 1010.

The second element 1020 is an interconnect between the first element 1010 and the third element 1030. The second element 1020 can be a transmission line that serves as a matching/phasing section between the first element 1010 and the third element 1030. In particular, the second element 1020 can perform as a transmission line at the lower band of 28 GHz and radiate, at least to some degree, of the fields at the upper band of 39 GHz. The second element 1020 can include a substantially straight transmission line or a transmission line that includes at least one curved, or meandering, portion. In some embodiments, the transmission line of the second element 1020 can be a phase shift transmission line that connects patches of the first element 1010 and the third element 1030.

As described herein, various embodiments of the present disclosure recognize that operating at separate frequency bands of 28 GHz and 39 GHz can result in reduced efficiency, propagation loss, and foliage and environmental interaction. Embodiments of the present disclosure further recognize complications of the design of a UE, such as the UE 116, because of the difference in wavelengths between the frequency bands of 28 GHz and 39 GHz. Accordingly, various embodiments of the present disclosure, such as the unit cell 900 and the unit cell 1000, provide a structure that addresses the challenges of reduced efficiency, propagation loss, and foliage and environmental interaction in devices that perform full scans at both upper and lower frequencies, such as 28 GHz and 39 GHz.

FIGS. 11A-11E illustrate various embodiments of the unit cell according to various embodiments of the present disclosure. The unit cells illustrated in FIGS. 11A-11E are for illustration only and should not be construed as limiting. Various features can be combined, added to, or removed from the unit cells illustrated in FIGS. 11A-11E without departing from the scope of the present disclosure. The various unit cells illustrated in FIGS. 11A-11E are not necessarily drawn to scale but depict various differences between the various unit cells. The various unit cells 1110, 1120, 1130, 1140, and 1150 can be implemented in dual-band and dual-band polarized mmWave array antennas to improve, or reduce, the side lobe level.

As described herein, the various unit cells 1110, 1120, 1130, 1140, and 1150 can be various representations of the unit cell 900 and the unit cell 1000. Accordingly, the various unit cells 1110, 1120, 1130, 1140, and 1150 can be implemented in an array to address the challenges of reduced efficiency, propagation loss, and foliage and environmental interaction in devices that perform full scans at both upper and lower frequencies, such as 28 GHz and 39 GHz.

Figure 11A:
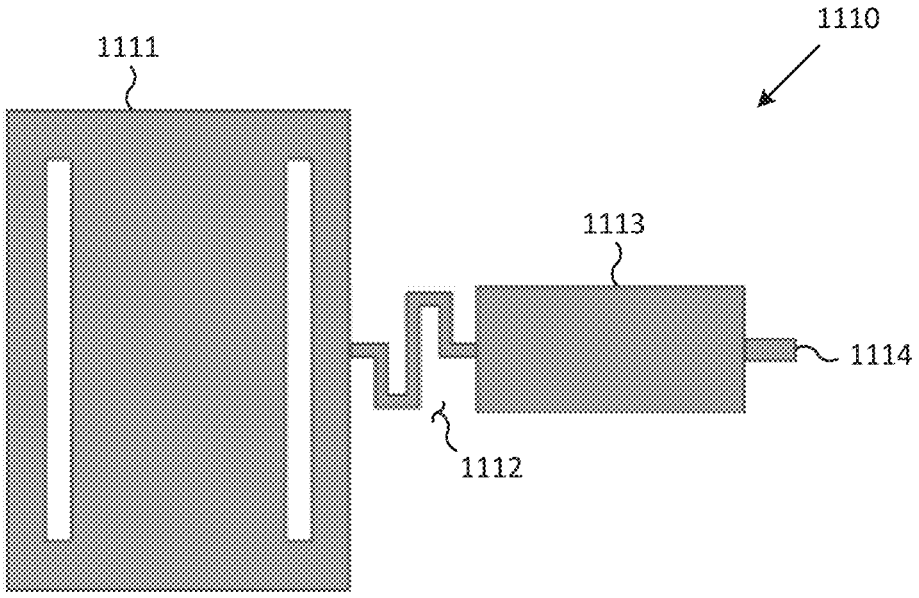
FIGS. 11A-11E illustrate various embodiments of the unit cell according to various embodiments of the present disclosure.

FIG. 11A illustrates a unit cell 1110 according to various embodiments of the present disclosure. The unit cell 1110 includes a first element 1111, a second element 1112, and a third element 1113 analogous to the first element 1010, second element 1020, and third element 1030, respectively. The unit cell 1110 further includes an excitation port, or transceiver, 1114 to receive power for the unit cell 1110. The first element 1111 includes two slots that each include a first width. The second element 1112 includes a transmission line of a first thickness. The third element 1113 is shown with a rectangular shape.

Figure 11B:
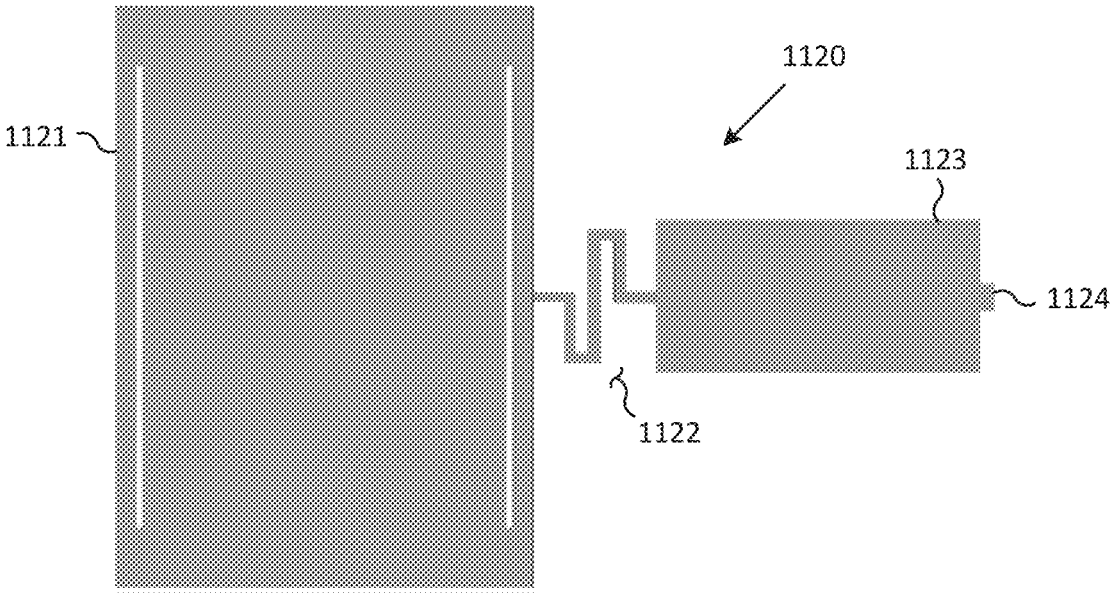

FIG. 11B illustrates a unit cell 1120 according to various embodiments of the present disclosure. The unit cell 1120 includes a first element 1121, a second element 1122, and a third element 1123 analogous to the first element 1010, second element 1020, and third element 1030, respectively. The unit cell 1120 further includes an excitation port, or transceiver, 1124 to receive power for the unit cell 1120. In comparison to the unit cell 1110, the first element 1121 includes two slots that each have a smaller width than the width of the first element 1111. The second element 1122 includes a transmission line that has a smaller thickness than the thickness of the transmission line of the second element 1112. The third element 1123 is shown with a rectangular shape similar to the shape of the third element 1113.

Figure 11C:
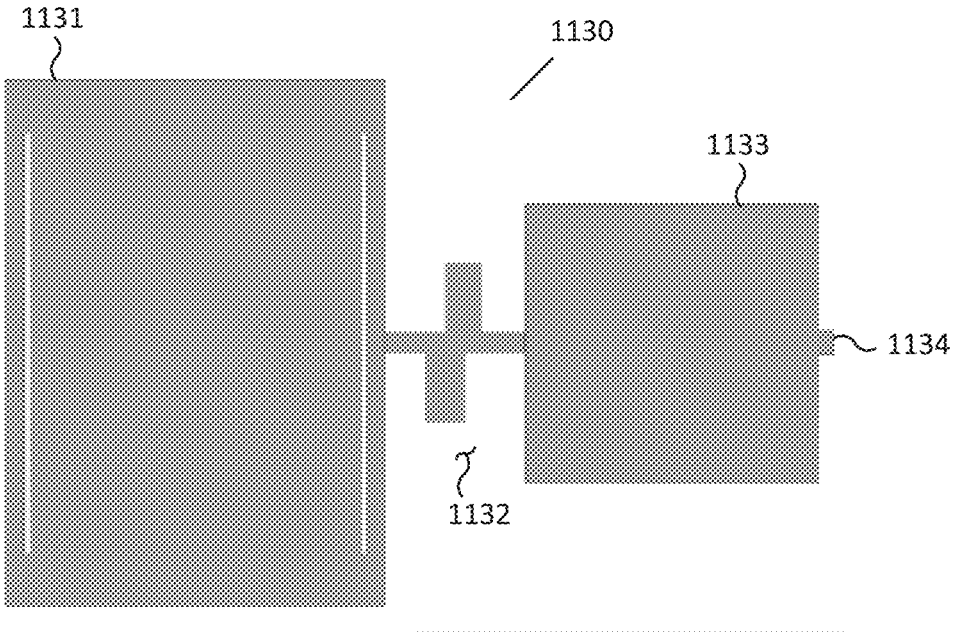

FIG. 11C illustrates a unit cell 1130 according to various embodiments of the present disclosure. The unit cell 1130 includes a first element 1131, a second element 1132, and a third element 1133 analogous to the first element 1010, second element 1020, and third element 1030, respectively. The unit cell 1130 further includes an excitation port, or transceiver, 1134 to receive power for the unit cell 1130. The first element 1131 can be similar to the first element 1121. However, the second element 1132 includes a branched transmission line rather than a single, curved transmission line as shown in the second element 1112 or the second element 1122. The transmission line of the second element 1132 includes a straight portion that connects the first element 1131 to the third element 1133. In addition, the transmission line of the second element 1132 includes two offset branched portions extending from the straight portion.

Further, the third element 1133 includes a larger patch than either of the third element 1113 or the third element 1123. Increasing or decreasing the size of the patch can manipulate the gain and beam steering capabilities of the unit cell 1130. For example, the third element 1133 is shown as substantially square, in contrast to the rectangular patches of the third element 1113 and 1123.

Figure 11D:
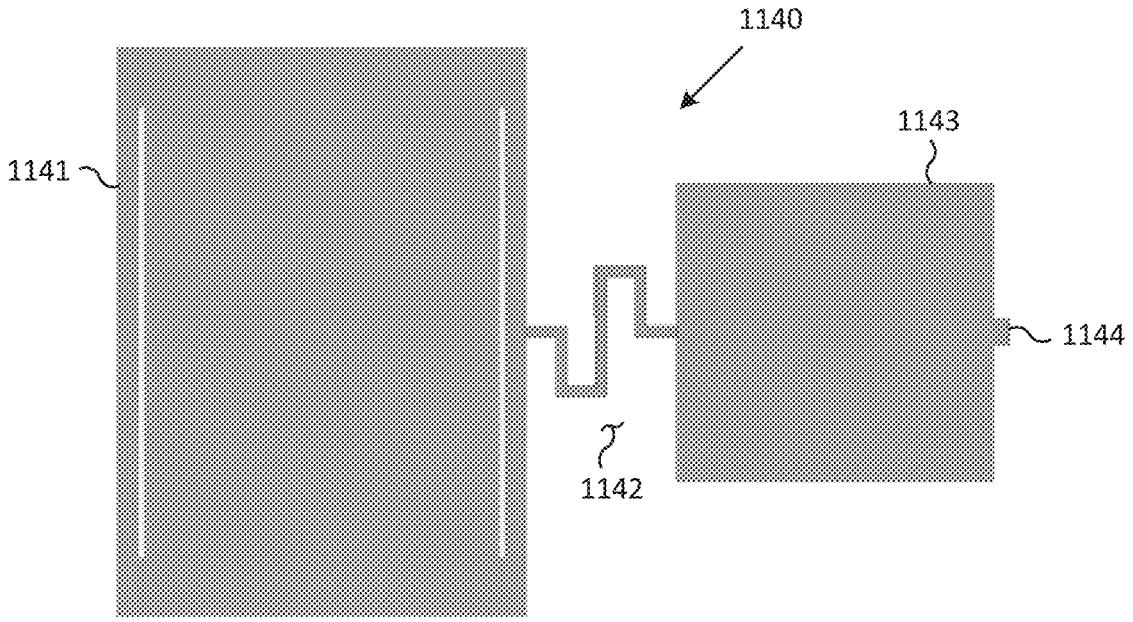

FIG. 11D illustrates a unit cell 1140 according to various embodiments of the present disclosure. The unit cell 1140 includes a first element 1141, a second element 1142, and a third element 1143 analogous to the first element 1010, second element 1020, and third element 1030, respectively. The unit cell 1140 further includes an excitation port, or transceiver, 1144 to receive power for the unit cell 1140. The size and shape of the third element 1143 is similar to that of the third element 1133. However, the second element 1142 is similar to the second element 1122 in thickness and structure. In other words, the transmission line of the second element 1142 has a thickness similar to the thickness of the transmission line of the second element 1122 and also includes the curved, or meandering, portion.

Figure 11E:
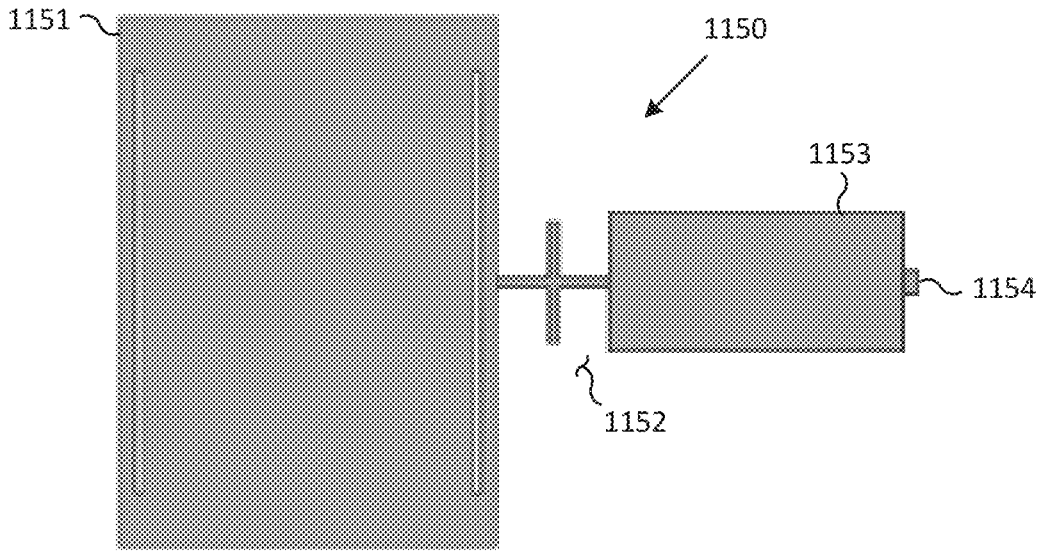

FIG. 11E illustrates a unit cell 1150 according to various embodiments of the present disclosure. The unit cell 1150 includes a first element 1151, a second element 1152, and a third element 1153 analogous to the first element 1010, second element 1020, and third element 1030, respectively. The unit cell 1150 further includes an excitation port, or transceiver, 1154 to receive power for the unit cell 1150. The third element 1153 has a size and substantially square shape similar to the third elements 1113 and 1123. The second element 1152 includes a branched transmission line that connects the first element 1151 to the third element 1153. However, in contrast to the offset branched portions of the transmission line in the second element 1132, the branched portions of the transmission line in the second element 1152 are not offset and are directly across from one another.

Although described herein as including two branched portions, various embodiments are possible. For example, the transmission line of the second element 1152 can include more or fewer than two branched portions off of the transmission line that connects the first element 1151 to the third element 1153. For example, the transmission line of the second element 1152 can include two branched portions on either side of the main transmission line that connects the first element 1151 to the third element 1153. As another example, the transmission line of the second element 1152 can include a different number of branched portions on one side of the main transmission line that connects the first element 1151 to the third element 1153 than on the other side.

In addition, various features of the embodiments of the unit cell 1000 described herein can be further combined or divided. For example, a curved transmission line of the unit cell, such as the transmission line of the second element 1142 of the unit cell 1140, can also include branched portions as shown in unit cells 1130 and 1150. As another example, the wider slots illustrated in unit cell 1110 can be applied to the first element of any of the unit cells 1120, 1130, 1140, and 1150 without departing from the scope of the present disclosure.

Figure 12A:
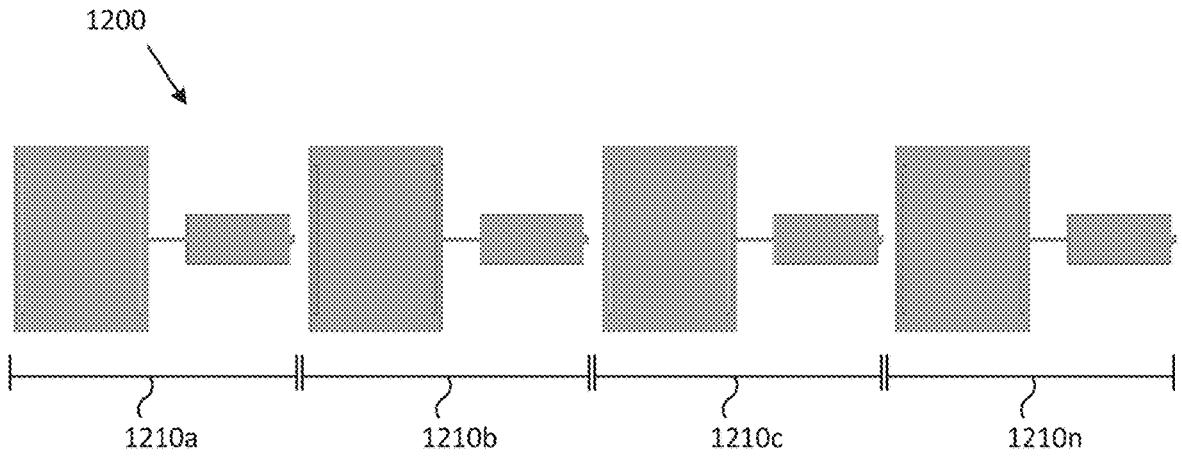
FIGS. 12A-12C illustrate antenna arrays according to various embodiments of the present disclosure.
Figure 12B:
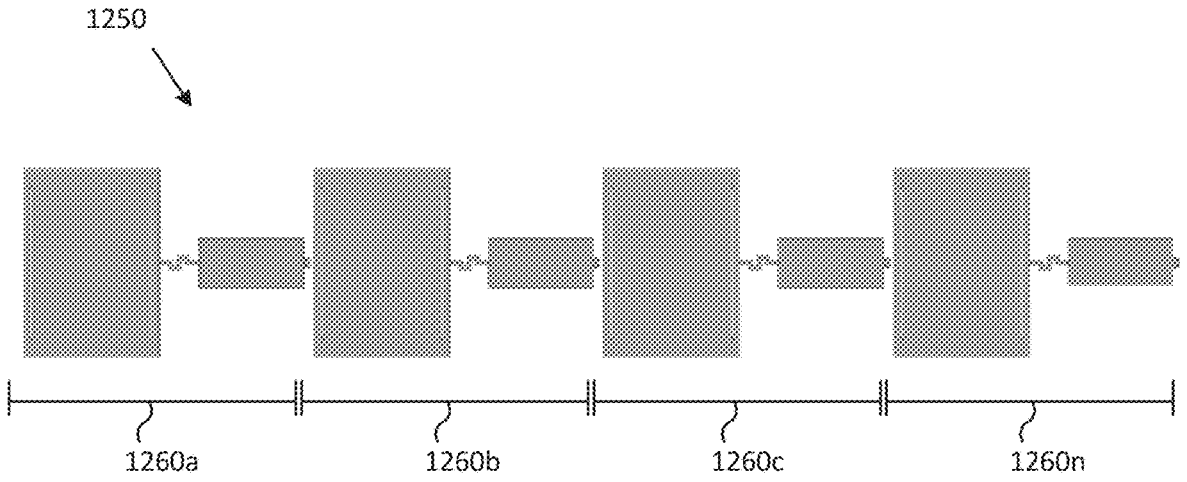
Figure 12C:
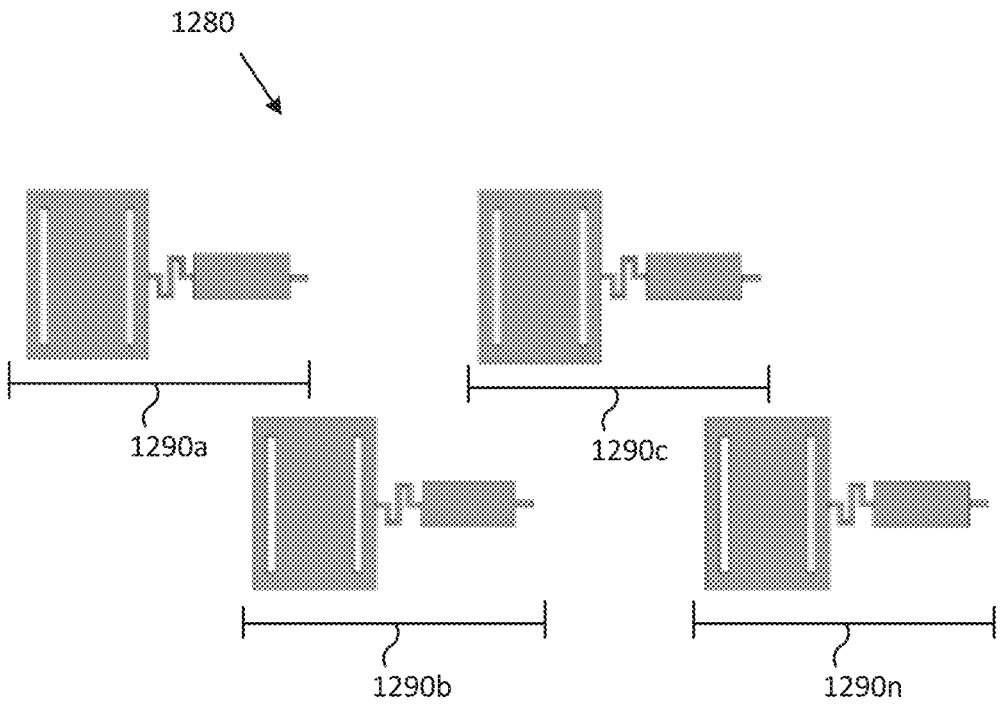

FIGS. 12A-12C illustrate array antennas according to various embodiments of the present disclosure. The array antennas illustrated in FIGS. 12A-12C are for illustration only and should not be construed as limiting. Various features can be combined, added to, or removed from the array antennas illustrated in FIGS. 12A-12C without departing from the scope of the present disclosure. The array antennas 1200, 1250, and 1280 can be dual-band and dual-band polarized mmWave array antennas to improve, or reduce, the side lobe level.

As described herein, each of the array antennas 1200, 1250, and 1280 illustrated in FIGS. 12A, 12B, and 12C, respectively, can include any combination of the unit cells 1110, 1120, 1130, 1140, and 1150. Therefore, the array antennas 1200, 1250, and 1280 are provided to address the challenges of reduced efficiency, propagation loss, and foliage and environmental interaction in devices that perform full scans at both upper and lower frequencies, such as 28 GHz and 39 GHz. In addition, the array antennas 1200, 1250, and 1280 improve the dual-band array antenna radiation performance (i.e., gain) while maintaining the form factor. The array antennas 1200, 1250, and 1280 also improve the side-lobe level of transmissions sent by the UE 116 in which the array antennas 1200, 1250, and 1280 are implemented and realize a dual-polarized radiation.

FIG. 12A illustrates an array antenna 1200 according to various embodiments of the present disclosure. The array antenna 1200 includes a plurality of unit cells 1210*a*-1210*n* connected in series. The array antenna 1200 can include any suitable number of unit cells 1210. Each of the unit cells 1210 can be the unit cell 900, 1000, 1110, 1120, 1130, 1140, or 1150. In some embodiments, as illustrated in FIG. 12A, each second element 1020 includes a straight transmission line between the first element 1010 and the third element 1030. The straight transmission line does not include a curved, or meandering, portion.

FIG. 12B illustrates an array antenna 1250 according to various embodiments of the present disclosure. The array antenna 1250 includes a plurality of unit cells 1260*a*-1260*n* connected in series. The array antenna 1250 can include any suitable number of unit cells 1260. Each of the unit cells 1260 can be the unit cell 900, 1000, 1110, 1120, 1130, 1140, or 1150. For example, the unit cells 1260 can be the unit cell 1120 where each respective third element 1123 is connected in series to the first element 1121 of the adjacent unit cell 1260. As shown in FIG. 12B, the transmission line of each second element 1122 includes a curved portion to adjust phasing between the first element 1121 and third element 1123.

FIG. 12C illustrates an array antenna 1280 according to various embodiments of the present disclosure. The array antenna 1280 includes a plurality of unit cells 1290*a*-1290*n* disposed in an offset arrangement. The array antenna 1280 can include any suitable number of unit cells 1290. Each of the unit cells 1290 can be the unit cell 900, 1000, 1110, 1120, 1130, 1140, or 1150. For example, the unit cells 1290 can be the unit cell 1120 where each respective third element 1123 is connected in series to the first element 1121 of the adjacent unit cell 1290. As shown in FIG. 12C, the transmission line of each second element 1122 includes a curved portion to adjust phasing between the first element 1121 and third element 1123.

In various embodiments of the present disclosure, the array antennas 1200, 1250, and 1280 can be provided as stacked dual-polarized dual-band array antennas. Various embodiments of the stacked dual-polarized dual-band array antennas are described herein. For example, the stacked dual-polarized dual-band array antennas can be provided with a first unit cell that supports both upper band and lower band transmissions, a second unit cell that supports upper band transmissions, and a connection between the first unit cell and the second unit cell. These various embodiments are illustrated in FIGS. 13A-15C, described below.

Figure 13A:
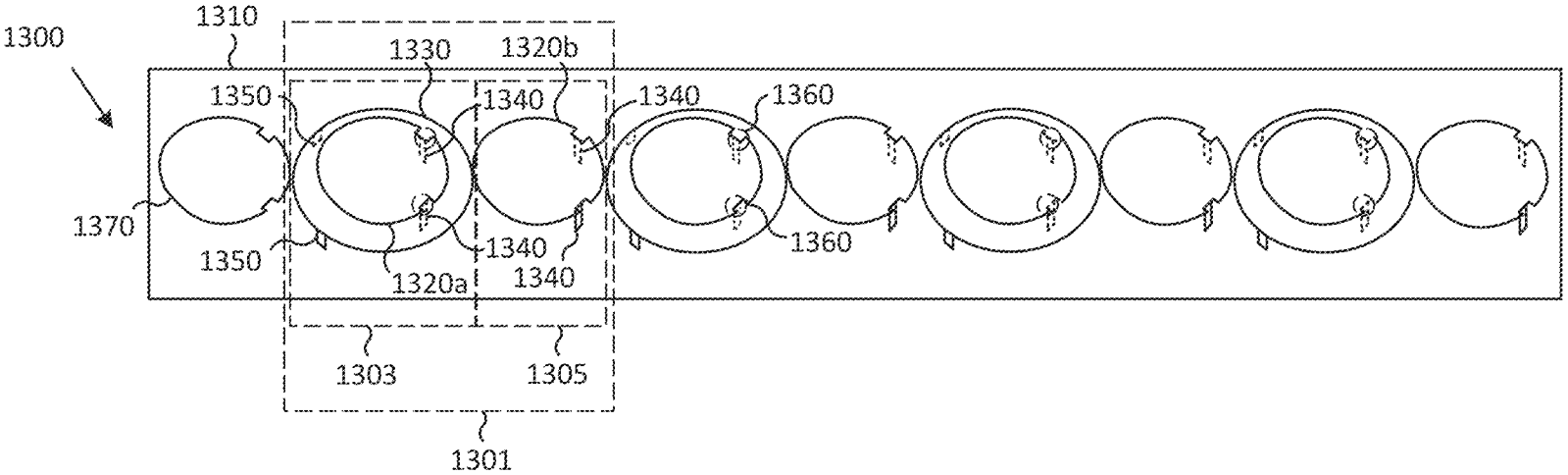
FIGS. 13A and 13B illustrate a stacked, dual-polarized dual-band antenna array according to various embodiments of the present disclosure.
Figure 13B:
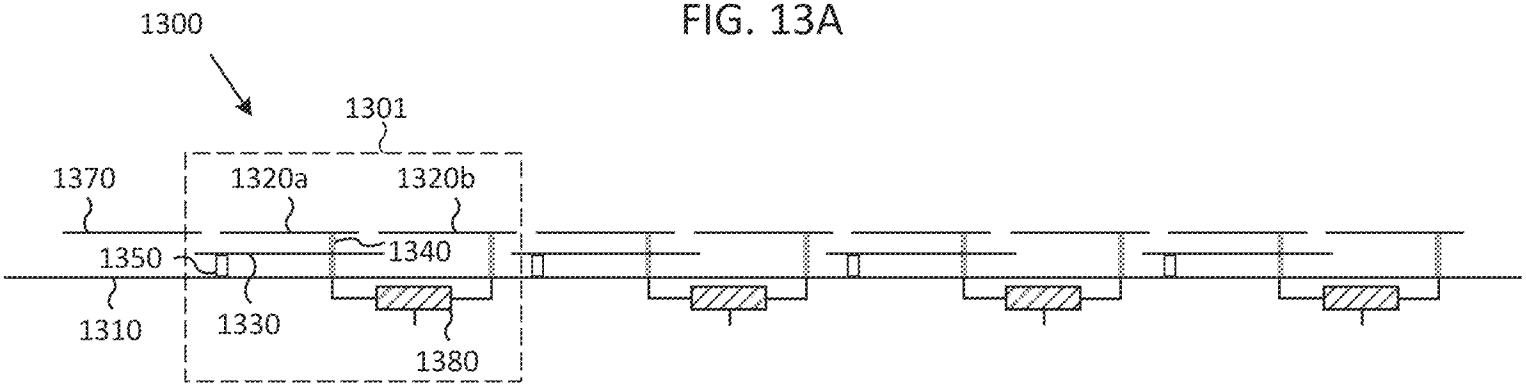

FIGS. 13A and 13B illustrate an array antenna according to various embodiments of the present disclosure. The antenna array 1300 illustrated in FIGS. 13A and 13B is for illustration only and should not be construed as limiting. Various features can be combined, added to, or removed from the antenna array 1300 illustrated in FIGS. 13A and 13B without departing from the scope of the present disclosure.

More specifically, FIG. 13A illustrates a top view of the antenna array 1300 and FIG. 13B illustrates a side view of the antenna array 1300. The antenna array 1300 includes a unit cell 1301. The antenna array 1300 can be any one of the array antennas 1200, 1250, 1280. The unit cell 1301 can be the unit cell 900, 1000, 1110, 1120, 1130, 1140, 1150, 1210, 1260, or 1290. The antenna array 1300 is a stacked dual-polarized dual-band array antenna. In various embodiments, the structure of the antenna array 1300 can reduce the side lobe level (SLL) of radiation emitted at one or both of an upper frequency band and a lower frequency band described herein.

As described herein, the antenna array 1300, including the unit cell 1301, can include any combination of the unit cells 1110, 1120, 1130, 1140, and 1150. Therefore, the antenna array 1300 is provided to address the challenges of reduced efficiency, propagation loss, and foliage and environmental interaction in devices that perform full scans at both upper and lower frequencies, such as 28 GHz and 39 GHz. In addition, the antenna array 1300 improves the dual-band array antenna radiation performance (i.e., gain) while maintaining the form factor. The antenna array 1300 also improves the side-lobe level of transmissions sent by the UE 116 in which the antenna array 1300 is implemented and realizes a dual-polarized radiation.

The unit cell 1301 is disposed on a ground plane 1310. In some embodiments, the ground plane 1310 can be a printed circuit board (PCB). The unit cell 1301 includes a first element 1303 and a second element 1305. The first element 1303 includes a lower band patch antenna 1330, such as a 28 GHz patch antenna, disposed proximate to the ground plane 1310 and an upper band patch antenna 1320*a*, such as a 39 GHz patch antenna, disposed proximate to the lower band patch antenna 1330. In other words, the lower band patch antenna 1330 is disposed between the ground plane 1310 and the upper band patch antenna 1320*a*. The first element 1303 further includes a first dual polarized feed 1340 for the upper band patch antenna 1320*a* and a second dual polarized feed 1350 for the lower band patch antenna 1330. The lower band patch antenna 1330 includes a pair of holes 1360 that allow the first dual polarized feed 1340 to travel through the lower band patch antenna 1330 from the ground plane 1310 to the upper band patch antenna 1320*a*.

The second element 1305 includes an upper band patch antenna 1320*b*, such as a 39 GHz patch antenna. The upper band patch antenna 1320*b* can be identical to the upper band patch antenna 1320*a* of the first element 1303, but the second element 1305 does not include a lower band patch antenna. The upper band patch antenna 1320*b* and the upper band patch antenna 1320*a* are each positioned in a first plane of the of the antenna array 1300 to radiate in the first frequency band.

Although each upper band patch antenna 1320*a*, 1320*b* and the lower band patch antenna 1330 are illustrated in FIGS. 13A and 13B as a circular shape, various embodiments are possible. One or both of the upper band patch antenna 1320 and the lower band patch antenna 1330 can be provided in any suitable shape without departing from the scope of the present disclosure. For example, one or both of the upper band patch antenna 1320 and the lower band patch antenna 1330 can be provided in shapes including, but not limited to, a rectangular shape, a triangular shape, or an irregular shape.

The unit cell 1301 further includes a splitter 1380. The splitter 1380 can be the second element 1020 that connects the first element 1303 and the second element 1305. For example, the splitter 1380 can feed the upper band patch antenna 1320*a* and the upper band patch antenna 1320*b*. In some embodiments, the splitter 1380 can be implemented on the ground plane 1310, such as the PCB, and placed on the opposite side of the ground plane 1310 from the other elements to allow one RFIC to feed two separate upper band patch antennas 1320*a*, 1320*b* at a single polarization. In embodiments where the unit cell 1301 is configured for single-polarized radiation, the non-connected ports can be off, e.g. floated or terminated by high impedance, in order to reduce coupling.

The antenna array 1300 includes a plurality of unit cells 1301 described herein. For example, the antenna array 1300 can include four unit cells 1301 as shown in FIGS. 13A and 13B. However, this embodiment should not be construed as limiting and various embodiments are possible. For example, the antenna array 1300 can include more or fewer than four unit cells 1301 without departing from the scope of the present disclosure.

In some embodiments, the antenna array 1300 further includes an additional, unconnected patch 1370 similar to the upper band patch antenna 1320. The unconnected patch 1370 can be referred to as a dummy patch because it does not include a mechanism for power transmission. The unconnected patch 1370 can be placed on the ground plane 1310 before the first unit cell 1301 to form a symmetric conductor shape with the upper band patch antenna 1320. The unconnected patch 1370 further improves the radiation pattern of the lower band patch antenna 1330 by being located in front of the lower band patch antenna 1330.

Figure 14A:
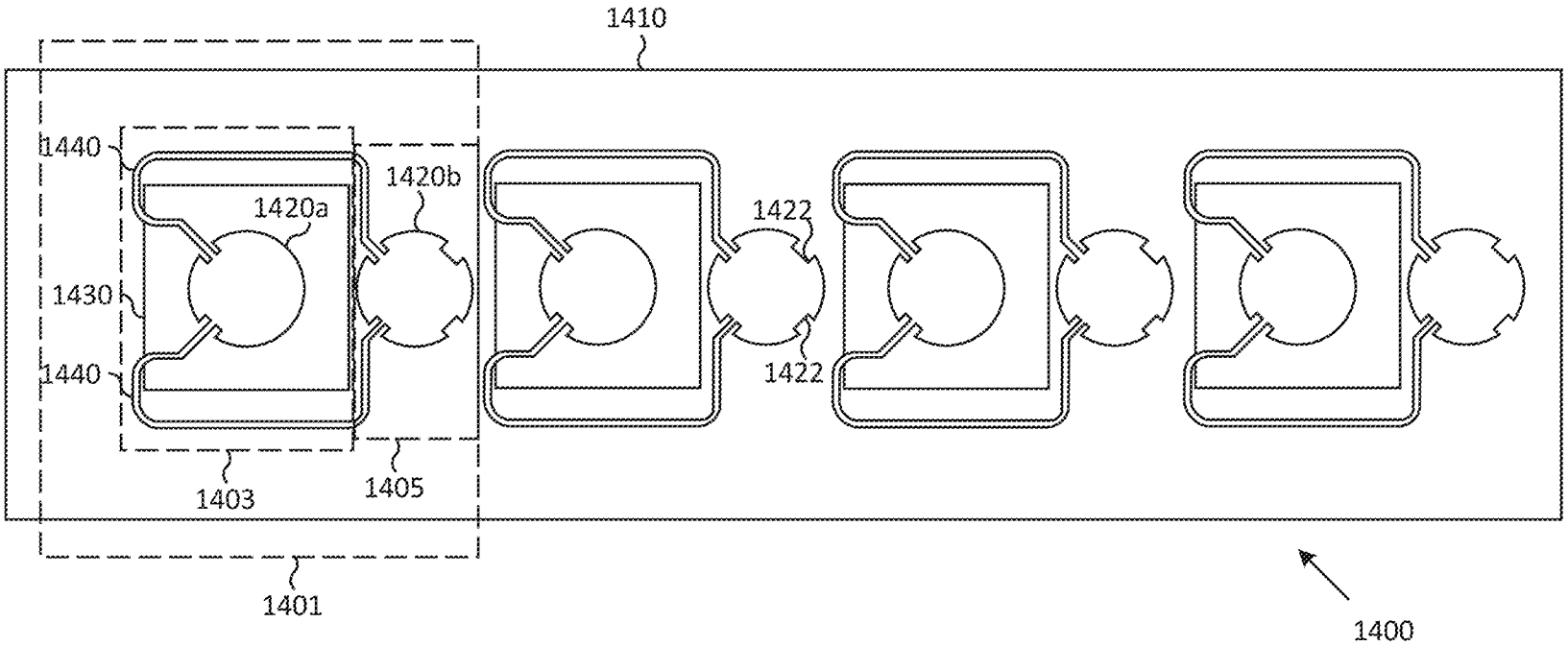
FIGS. 14A and 14B illustrate a stacked, dual-polarized dual-band antenna array according to various embodiments of the present disclosure.
Figure 14B:
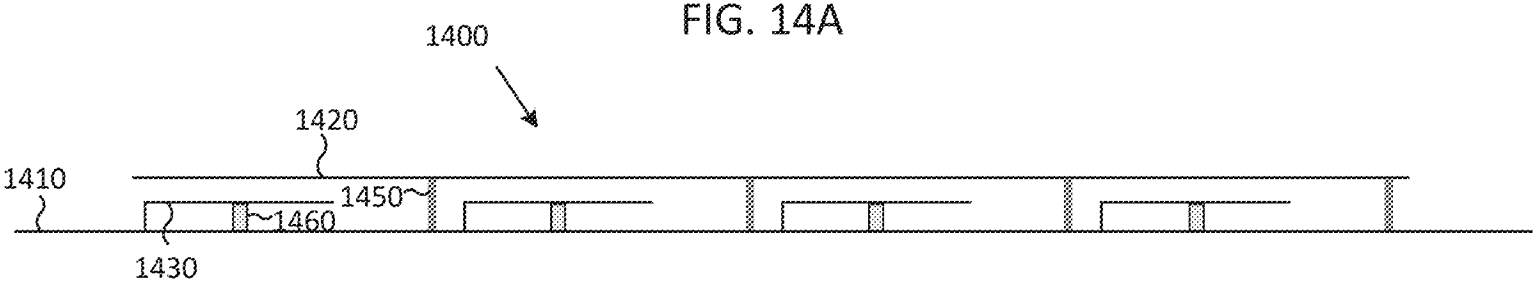

FIGS. 14A and 14B illustrate an array antenna according to various embodiments of the present disclosure. The antenna array 1400 illustrated in FIGS. 14A and 14B is for illustration only and should not be construed as limiting. Various features can be combined, added to, or removed from the antenna array 1400 illustrated in FIGS. 14A and 14B without departing from the scope of the present disclosure.

More specifically, FIG. 14A illustrates a top view of the antenna array 1400 and FIG. 14B illustrates a side view of the antenna array 1400. The antenna array 1400 includes a unit cell 1401. The antenna array 1400 can be any one of the array antennas 1200, 1250, 1280. The unit cell 1401 can be the unit cell 900, 1000, 1110, 1120, 1130, 1140, 1150, 1210, 1260, or 1290. The antenna array 1400 is a stacked dual-polarized dual-band array antenna that uses a phase shift line to achieve the desired polarization. In various embodiments, the structure of the antenna array 1400 can reduce the side lobe level (SLL) of radiation emitted at one or both of an upper frequency band and a lower frequency band described herein.

As described herein, the antenna array 1400, including the unit cell 1401, can include any combination of the unit cells 1110, 1120, 1130, 1140, and 1150. Therefore, the antenna array 1400 is provided to address the challenges of reduced efficiency, propagation loss, and foliage and environmental interaction in devices that perform full scans at both upper and lower frequencies, such as 28 GHz and 39 GHz. In addition, the antenna array 1400 improves the dual-band array antenna radiation performance (i.e., gain) while maintaining the form factor. The antenna array 1400 also improves the side-lobe level of transmissions sent by the UE 116 in which the antenna array 1400 is implemented and realizes a dual-polarized radiation.

The unit cell 1401 is disposed on a ground plane 1410. In some embodiments, the ground plane 1410 can be a printed circuit board (PCB). The unit cell 1401 includes a first element 1403 and a second element 1405. The first element 1403 includes a lower band patch antenna 1430, such as a 28 GHz patch antenna, disposed proximate to the ground plane 1410 and an upper band patch antenna 1420*a*, such as a 39 GHz patch antenna, disposed proximate to the lower band patch antenna 1430. In other words, the lower band patch antenna 1430 is disposed between the ground plane 1410 and the upper band patch antenna 1420*a*.

The second element 1405 includes an upper band patch antenna 1420*b*, such as a 39 GHz patch antenna. The upper band patch antenna 1420*b* can be identical to the upper band patch antenna 1420*a* of the first element 1403, but the second element 1405 does not include a lower band patch antenna. The upper band patch antenna 1420*b* and the upper band patch antenna 1420*a* are each positioned in a first plane of the of the antenna array 1400 to radiate in the first frequency band.

The upper band patch antenna 1420, as included in either the first element 1403 or the second element 1405, can be circular with notches 1422 to receive a transmission line. For example, as shown in FIG. 14A, the unit cell 1401 further includes phase shift transmission lines 1440 that connect the upper band patch antenna 1420*a* of the first element 1403 to the upper band patch antenna 1420*b* of the second element 1405. As illustrated in FIG. 14A, each upper band patch antenna 1420 can include four notches 1422. However, various embodiments are possible and each upper band patch antenna 1420 can include more or fewer than four notches 1422 without departing from the scope of the present disclosure. In some embodiments, the antenna array 1400 further includes a transmission line 1450 that is a dual polarized feed to excite the upper band patch antenna 1420 and a transmission line 1460 that is a dual polarized feed to excite the lower band patch antenna 1430.

The phase shift transmission lines 1440 can be the second element 1020. In particular, the phase shift transmission lines 1440 can shift a phase of the unit cell of the upper band patch antenna 1420 and provide dual-polarized radiation for the antenna array 1400. In some embodiments, the phase shift transmission lines 1440 can make phase-inverted copies of the signals to feed an adjacent upper band patch antenna 1420 in series of the antenna array 1400. In some embodiments, the unit cell 1401 includes a set of two phase shift transmission lines 1440. One of the set of two phase shift transmission lines 1440 can be excited by the upper band patch antenna 1420*b* and the upper band patch antenna 1420*a* is excited by the one of the set of two phase shift transmission lines 1440 from the upper band patch antenna

1420*b*. For example, the upper band patch antenna 1420*a* can be excited by a phase-inverted copy of a signal that excites the upper band patch antenna 1420*b*.

Although the upper band patch antenna 1420 and the lower band patch antenna 1430 are illustrated in FIGS. 14A and 14B as a circular shape and square shape, respectively, various embodiments are possible. One or both of the upper band patch antenna 1420 and the lower band patch antenna 1430 can be provided in any suitable shape without departing from the scope of the present disclosure. For example, one or both of the upper band patch antenna 1420 and the lower band patch antenna 1430 can be provided in shapes including, but not limited to, a circular shape, a rectangular shape, a triangular shape, or an irregular shape.

Figure 15A:
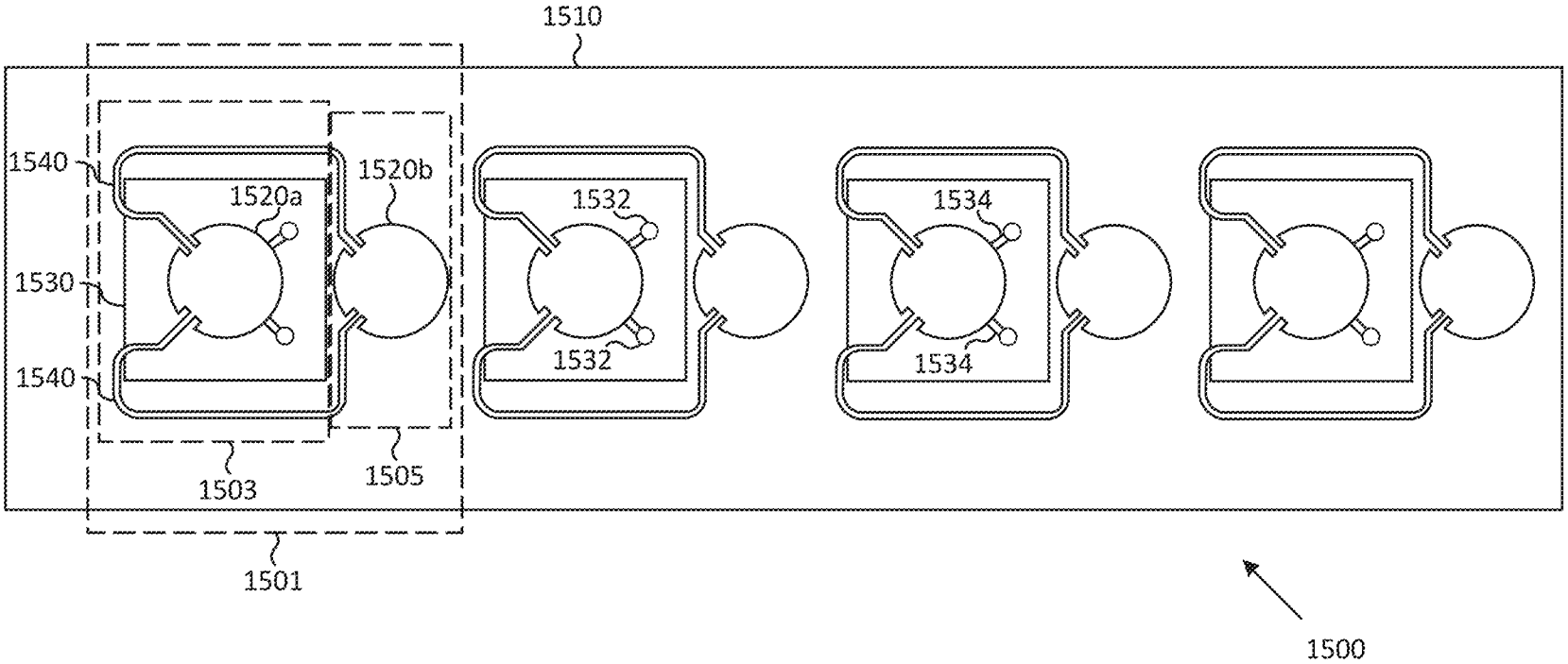
FIGS. 15A-15C illustrate an antenna array according to various embodiments of the present disclosure.
Figure 15B:
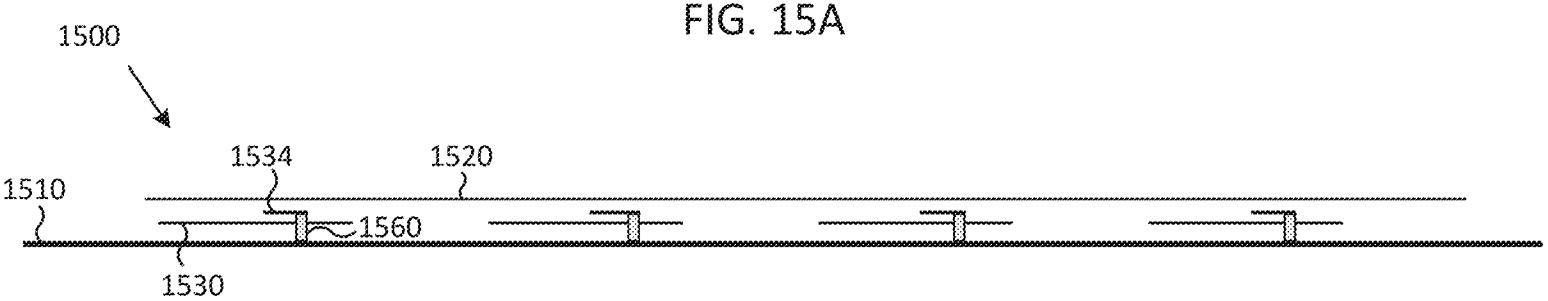
Figure 15C:
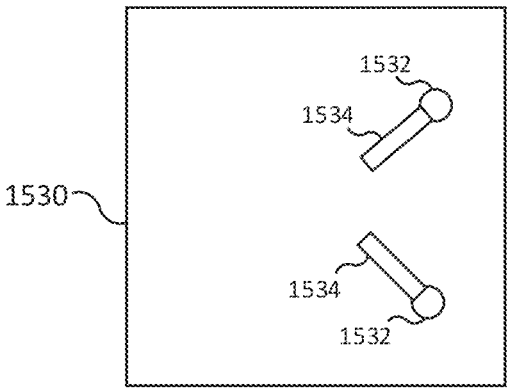

FIGS. 15A-15C illustrate an array antenna according to various embodiments of the present disclosure. The antenna array 1500 illustrated in FIGS. 15A-15C is for illustration only and should not be construed as limiting. Various features can be combined, added to, or removed from the antenna array 1500 illustrated in FIGS. 15A-15C without departing from the scope of the present disclosure.

More specifically, FIG. 15A illustrates a top view of the antenna array 1500. FIG. 15B illustrates a side view of the antenna array 1500. FIG. 15C illustrates a top view of the lower band patch antenna 1530. The antenna array 1500 includes a unit cell 1501. The antenna array 1500 can be any one of the array antennas 1200, 1250, 1280. The unit cell 1501 can be the unit cell 900, 1000, 1110, 1120, 1130, 1140, 1150, 1210, 1260, or 1290. The antenna array 1500 is a stacked dual-polarized dual-band array antenna that uses a phase shift line with a feed coupler to achieve the desired polarization. In various embodiments, the structure of the antenna array 1500 can reduce the side lobe level (SLL) of radiation emitted at one or both of an upper frequency band and a lower frequency band described herein.

As described herein, the antenna array 1500, including the unit cell 1501, can include any combination of the unit cells 1110, 1120, 1130, 1140, and 1150. Therefore, the antenna array 1500 is provided to address the challenges of reduced efficiency, propagation loss, and foliage and environmental interaction in devices that perform full scans at both upper and lower frequencies, such as 28 GHz and 39 GHz. In addition, the antenna array 1500 improves the dual-band array antenna radiation performance (i.e., gain) while maintaining the form factor. The antenna array 1500 also improves the side-lobe level of transmissions sent by the UE 116 in which the antenna array 1500 is implemented and realizes a dual-polarized radiation.

The unit cell 1501 is disposed on a ground plane 1510. In some embodiments, the ground plane 1510 can be a printed circuit board (PCB). The unit cell 1501 includes a first element 1503 and a second element 1505. The first element 1503 includes a lower band patch antenna 1530, such as a 28 GHz patch antenna, disposed proximate to the ground plane 1510 and an upper band patch antenna 1520*a*, such as a 39 GHz patch antenna, disposed proximate to the lower band patch antenna 1530. In other words, the lower band patch antenna 1530 is disposed between the ground plane 1510 and the upper band patch antenna 1520*a*.

The lower band patch antenna 1530 includes one or more holes 1532. The holes 1532 are of a sufficient size to allow a vertical feed 1560 to extend through the lower band patch antenna 1530 via the hole 1532. The vertical feed 1560 can be referred to as a vertical coupler or a vertical feed coupler. Each vertical feed 1560 can extend from the ground plane 1510 through one of the holes 1532 and connect to a horizontal feed 1534. The horizontal feed 1534 can be referred to as a horizontal coupler or a horizontal feed coupler. The horizontal feed 1534 is provided between the lower band patch antenna 1530 and the upper band patch antenna 1520 and can excite one or both of the lower band patch antenna 1530 and the upper band patch antenna 1520.

In various embodiments, the vertical feed 1560 and the horizontal feed 1534 are able to feed each of the lower band patch antenna 1530 and the upper band patch antenna 1520 simultaneously. For example, the horizontal feed 1534 can feed the lower band patch antenna 1530 below the horizontal feed 1534 and can feed the upper band patch antenna 1520 above the horizontal feed 1534.

The second element 1505 includes an upper band patch antenna 1520*b*, such as a 39 GHz patch antenna. The upper band patch antenna 1520*b* can be identical to the upper band patch antenna 1520*a* of the first element 1503, but the second element 1505 does not include a lower band patch antenna. The upper band patch antenna 1520*b* and the upper band patch antenna 1520*a* are each positioned in a first plane of the of the antenna array 1500 to radiate in the first frequency band.

The upper band patch antenna 1520, as included in either the first element 1503 or the second element 1505, can be circular. For example, as shown in FIG. 15A, the unit cell 1501 further includes transmission lines 1540 that connect the upper band patch antenna 1520*a* of the first element 1503 to the upper band patch antenna 1520*b* of the second element 1505.

The phase shift transmission lines 1540 can be the second element 1020. In particular, the phase shift transmission lines 1540 can shift a phase of the unit cell of the upper band patch antenna 1520 and provide dual-polarized radiation for the antenna array 1500. In some embodiments, the phase shift transmission lines 1540 can make phase-inverted copies of the signals to feed an adjacent upper band patch antenna 1520 in series of the antenna array 1500. In particular, the embodiment of the antenna array 1500 can be used with a single RFIC port to support dual-band polarization. In some embodiments, the unit cell 1501 includes a set of two phase shift transmission lines 1540. One of the set of two phase shift transmission lines 1540 can be excited by the upper band patch antenna 1520*b* and the upper band patch antenna 1520*a* is excited by the one of the set of two phase shift transmission lines 1540 from the upper band patch antenna 1520*b*. For example, the upper band patch antenna 1520*a* can be excited by a phase-inverted copy of a signal that excites the upper band patch antenna 1520*b*.

Although the upper band patch antenna 1520 and the lower band patch antenna 1530 are illustrated in FIGS. 15A-15C as a circular shape and square shape, respectively, various embodiments are possible. One or both of the upper band patch antenna 1520 and the lower band patch antenna 1530 can be provided in any suitable shape without departing from the scope of the present disclosure. For example, one or both of the upper band patch antenna 1520 and the lower band patch antenna 1530 can be provided in shapes including, but not limited to, a circular shape, a rectangular shape, a triangular shape, or an irregular shape.

FIG. 15C illustrates the lower band patch antenna 1530 according to various embodiments of the present disclosure. As shown in FIG. 15C, the lower band patch antenna 1530 includes the one or more holes, or ports, 1532. The vertical feeds 1560 extend through the holes 1532 and connect to the horizontal feeds 1534. The horizontal feeds 1534 extend from the holes 1532, respectively, toward a center of the lower band patch antenna 1530. By extending from the holes 1532 toward the center of the lower band patch antenna

1530, the horizontal feed 1534 is able to feed both the lower band patch antenna 1530 below the horizontal feed 1534 and the upper band patch antenna 1520 above the horizontal feed 1534.

Although described herein as part of the lower band patch antenna 1530, various embodiments are possible. For example, one or more of the holes 1532, horizontal feeds 1534, and vertical feeds 1560 can be implemented on the lower band patch antenna 1430 or the lower band patch antenna 1330 without departing from the scope of the present disclosure.

In some embodiments, an antenna array includes a plurality of unit cells. Each unit cells includes first and second patches, phase shift transmission lines, a third patch, and a transmission line. The first and second patches are configured to radiate at a first frequency band and positioned in a first plane of the antenna array. The phase shift transmission lines connect the first and second patches and are configured to shift a phase of a signal between the first and second patches. The third patch is positioned in a second plane of the antenna array and beneath the first patch and radiates at a second frequency band that is lower than the first frequency band. The transmission line is configured to excite at least the third patch.

In some embodiments, the third patch includes a port and the transmission line passes through the port to excite both the first patch and the third patch. The transmission line can include a vertical feed coupler that extends through the port and a horizontal feed coupler that extends from the vertical feed coupler to excite the first patch and the third patch.

In some embodiments, the antenna array includes a second transmission line configured to excite the second patch. One of the set of phase shift transmission lines can be excited by the second patch and the first patch can be excited by the one of the set of phase shift transmission lines from the second patch. In some embodiments, the first patch is excited by a phase-inverted copy of a signal that that excites the second patch.

In some embodiments, the antenna array includes a splitter configured to feed the first patch and the second patch. In some embodiments, radiation emitted at at least one of the first frequency band or the second frequency band includes a reduced side lobe level. In some embodiments, each of the phase shift transmission lines provide dual-polarized radiation. In some embodiments, the first frequency is a 39 GHz frequency band and the second frequency is a 28 GHz frequency band.

In some embodiments, a UE includes a transceiver configured to transmit and receive signals via an antenna array. The antenna array is operably connected to the transceiver and includes a plurality of unit cells. Each unit cell includes first and second patches, phase shift transmission lines, a third patch, and a transmission line. The first and second patches are configured to radiate at a first frequency band and positioned in a first plane of the antenna array. The phase shift transmission lines connect the first and second patches and are configured to shift a phase of a signal between the first and second patches. The third patch is positioned in a second plane of the antenna array and beneath the first patch and radiates at a second frequency band that is lower than the first frequency band. The transmission line is configured to excite at least the third patch.

Although the present disclosure has been described with an exemplary embodiment, various changes and modifications may be suggested to one skilled in the art. It is intended that the present disclosure encompass such changes and modifications as fall within the scope of the appended claims. None of the description in this application should be read as implying that any particular element, step, or function is an essential element that must be included in the claims scope.

What is claimed is:

1. An antenna array comprising:

a plurality of unit cells, each unit cell comprising:

first and second patches, the first and second patches configured to radiate at a first frequency band and positioned in a first plane oriented along a first direction of the antenna array;

a set of phase shift transmission lines connecting the first and second patches and configured to shift a phase of a signal between the first and second patches;

a third patch positioned in a second plane oriented along the first direction of the antenna array and beneath the first patch that is in the first plane, the third patch configured to radiate at a second frequency band that is lower than the first frequency band; and a transmission line configured to excite at least the third patch.

2. The antenna array of claim 1, wherein:

the third patch includes a port, and the transmission line passes through the port to excite both the first patch and the third patch.

3. The antenna array of claim 2, wherein the transmission line includes:

a vertical feed coupler that extends through the port, and a horizontal feed coupler that extends from the vertical feed coupler to excite the first patch and the third patch.

4. The antenna array of claim 1, wherein the antenna array further comprises a second transmission line configured to excite the second patch.

5. The antenna array of claim 4, wherein:

one of the set of phase shift transmission lines is excited by the second patch, and the first patch is excited by the one of the set of phase shift transmission lines from the second patch.

6. The antenna array of claim 5, wherein the first patch is excited by a phase-inverted copy of a signal that that excites the second patch.

7. The antenna array of claim 1, further comprising a splitter configured to feed the first patch and the second patch.

8. The antenna array of claim 1, wherein the antenna array is configured to emit radiation at least one of the first frequency band or the second frequency band with a reduced side lobe level.

9. The antenna array of claim 1, wherein each of the phase shift transmission lines provide dual-polarized radiation.

10. The antenna array of claim 1, wherein the first frequency band is a 39 GHz frequency band and the second frequency band is a 28 GHz frequency band.

11. A user equipment (UE) comprising:

a transceiver configured to transmit and receive signals via an antenna array; and the antenna array operably connected to the transceiver, the antenna array comprising a plurality of unit cells, each unit cell including:

first and second patches, the first and second patches configured to radiate at a first frequency band and positioned in a first plane oriented along a first direction of the antenna array;

a set of phase shift transmission lines connecting the first and second patches and configured to shift a phase of a signal between the first and second patches;

a third patch positioned in a second plane oriented along the first direction of the antenna array and beneath the first patch that is in the first plane, the third patch configured to radiate at a second frequency band that is lower than the first frequency band; and a transmission line configured to excite at least the third patch.

12. The UE of claim 11, wherein:

the third patch includes a port, and the transmission line passes through the port to excite both the first patch and the third patch.

13. The UE of claim 12, wherein the transmission line includes:

a vertical feed coupler that extends through the port, and a horizontal feed coupler that extends from the vertical feed coupler to excite the first patch and the third patch.

14. The UE of claim 11, wherein the antenna array further comprises a second transmission line configured to excite the second patch.

15. The UE of claim 14, wherein:

one of the set of phase shift transmission lines is excited by the second patch, and the first patch is excited by the one of the set of phase shift transmission lines from the second patch.

16. The UE of claim 15, wherein the first patch is excited by a phase-inverted copy of a signal that that excites the second patch.

17. The UE of claim 11, further comprising a splitter configured to feed the first patch and the second patch.

18. The UE of claim 11, wherein the antenna array is configured to emit radiation at at least one of the first frequency band or the second frequency band with a reduced side lobe level.

19. The UE of claim 11, wherein each of the phase shift transmission lines provide dual-polarized radiation.

20. The UE of claim 11, wherein the first frequency band is a 39 GHz frequency band and the second frequency band is a 28 GHz frequency band.

* * * * *